United States Patent [19]

Enriquez

[11] 4,057,427

[45] Nov. 8, 1977

[54] PEROXIDE REDOX AMPLIFICATION IMAGING USING MANGANESE CATALYST IMAGES

[75] Inventor: Philip Maury Enriquez, Rochester, N.Y.

[73] Assignee: Eastman Kodak Company, Rochester, N.Y.

[21] Appl. No.: 648,079

[22] Filed: Jan. 12, 1976

[51] Int. Cl.[2] ..... G03C 7/00; G03C 5/24

[52] U.S. Cl. ..... 96/55; 96/54; 96/59; 96/60 R; 96/61 R; 96/61 M; 96/60 BF; 96/48 PD; 96/48 R; 96/49; 96/48 HD

[58] Field of Search ..... 96/48 R, 60 BF, 59, 96/48 PD, 48 HD, 22, 49, 60 R, 54, 55, 61 R, 61 M

[56] References Cited

U.S. PATENT DOCUMENTS 3,615,508 10/1971 Stephen et al. ..... 96/60 BF
3,764,490 12/1973 Matejec et al. ..... 96/55
3,776,730 12/1973 Matejec et al. ..... 96/48 R

FOREIGN PATENT DOCUMENTS 1,329,444 9/1973 United Kingdom ..... 96/48 PD

OTHER PUBLICATIONS

Research Disclosure, vol. 126, Item 13505 (07-1975).

*Primary Examiner*—Won H. Louie, Jr.
*Attorney, Agent, or Firm*—Carl O. Thomas

[57] ABSTRACT

A method is disclosed of forming a dye image through redox amplification using a peroxide oxidizing agent. This is accomplished by forming an immobile cobalt complex image and using this image to define a reversal immobile catalytic manganese complex image. The immobile catalytic manganese complex image is employed as a catalyst in a peroxide redox amplification step to form an image dye.

85 Claims, 23 Drawing Figures

PEROXIDE REDOX AMPLIFICATION IMAGING USING MANGANESE CATALYST IMAGES

FIELD OF THE INVENTION

The present invention relates to a novel process for producing photographic dye images. More specifically, the present invention relates to a process of producing photographic dye images through a redox amplification reaction utilizing a peroxide oxidizing agent. Still more specifically, this invention is concerned with a novel process for producing photographic dye images through a peroxide redox amplification reaction wherein an efficient redox amplification reaction catalyst image is formed.

BACKGROUND OF THE INVENTION

It is old and well-known in the photographic art to reduce silver halide grains bearing a latent image with a dye-image-generating reducing agent, such as a color-developing agent, capable of providing a dye-image-generating reaction product. For example, color-developing agents react with silver halide grains bearing a latent image to form silver and oxidized color-developing agent. The oxidized color-developing agent can then react with a photographic color coupler to form a dye image. It is conventional practice to remove the silver image by bleaching and to leave the dye image for final viewing.

It has been recognized in the art that the density of the dye image which can be produced with a given amount of silver halide and exposure can be increased through the use of a redox amplification procedure. In redox amplification processes, a portion of the dye image can be formed just as in conventional silver halide development, as described above. In addition, the silver image, which in conventional color processing is a by-product of development of the dye image, is employed as an immobile catalyst to achieve the imagewise reaction of dye-image-generating reducing agent and an oxidizing agent, wherein the dye-image-generating reducing agent and the oxidizing agent are chosen so as to be substantially inert to oxidation-reduction reaction in the absence of the catalyst. The result is that a second reaction path is opened for the imagewise generation of a dye. As a practical matter, most or even all of the final dye image can be attributable to the redox reaction rather than development-generated dye. In redox amplification processing to form dye images, it is possible to employ such low silver contents that bleaching of the silver image can be readily dispensed with.

Cobalt(III) complex and peroxide oxidizing agents have been employed separately in redox amplification reactions. Although some catalysts, such as silver, are useful for redox amplification reactions employing either oxidizing agent, the catalyst requirements of the oxidizing agents are not coextensive and can be widely divergent. Accordingly, redox amplification processes employing peroxide oxidizing agents or, more succinctly, peroxide redox amplification processes have been treated in the art separately from redox amplification processes employing cobalt(III) complex oxidizing agents. For example, Matejec, U.S. Pat. No. 3,764,490 issued July 4, 1972, teaches the forming of a photographic silver image which can then be used to catalyze the redox reaction of a peroxide oxidizing agent and a color-developing agent. Useful catalytic materials are not limited to photographic silver images, but include noble metals of Groups Ib and VIII of the periodic table generally. Weyde et al, U.S. Pat. No. 3,684,511 issued Aug. 15, 1972, teach imagewise-exposing an iodoform or derivative compound to form a catalyst image for peroxide redox amplification.

British Pat. No. 1,329,444 published Sept. 5, 1973, teaches forming negative images through peroxide redox amplification. A peroxide redox amplification catalyst is formed by imagewise-exposing a simple or complex salt of a heavy metal of Group VIb, VIIb or VIII of the periodic table with a mono- or polybasic carboxylic acid. The formation of cobalt, iron and manganese complex catalyst images are specifically disclosed. British Pat. No. 1,341,719 is directed to an improvement of the above-noted process, wherein it is taught to stabilize photographic elements containing dye images produced by certain specified peroxide redox amplification reactions so that it is unnecessary to wash out the reaction products while at the same time avoiding dye fogging on storage. Stabilization is said to be achieved through the use of polyvalent metal ions of metals of Groups Ib, IIb, IIIb, IVb, Vb, VIb, VIIb and VIII of the periodic table.

While gelatin is known to contain as impurities metals of a type which are known catalysts for peroxide redox amplification reactions, such as manganese, I am unaware of any teaching in the art to make use of these impurities in forming dye images through redox amplification reactions.

The use of cobalt(III) complexes in bleach-fix solutions is generally well-known in the art. British Pat. No. 777,635, for example, teaches the simultaneous bleaching and fixing of a subtractive color negative using a cobalt aquo-ammine cationic complex and a silver halide solvent as the bleaching and fixing agents. Stephen, U.S. Pat. No. 3,615,508 issued Oct. 26, 1971, teaches bleaching and fixing with a cobalt(III) ammine or amine complex, a thiosulfate fixing agent and a salt of an ammine or amine cation having an ionizable proton.

Bissonette, U.S. Ser. No. 402,432 filed Oct. 1, 1973, commonly assigned, now U.S. Pat. No. 3,923,511, issued Oct. 12, 1975, teaches concurrently bleaching and forming a redox amplification dye image in a monobath containing a cobalt(III) complex functioning both as an oxidizing agent and a bleaching agent. Bissonette, U.S. Ser. No. 602,156 filed Aug. 6, 1975, commonly assigned, now abandoned and refiled Oct. 12, 1976, as U.S. Ser. No. 731,284, teaches bleaching a silver image in a photographic element using a cobalt(III) complex to form an immobile cobalt image pattern which can be used as a catalyst for a peroxide redox amplification reaction. Bissonette, U.S. Ser. No. 609,880 filed Sept. 2, 1975, commonly assigned, now abandoned and refiled Oct. 8, 1976, as U.S. Ser. No. 730,914, teaches the combination of peroxide and cobalt(III) complex redox amplification in a single process wherein an immobile cobalt reaction product formed by cobalt redox amplification serves as a catalyst for peroxide redox amplification.

It is known in the art that cobalt(III) complexes can be exposed to light to form images. For example, Hickman et al, U.S. Pat. No. 1,897,843 issued Feb. 14, 1933, teach mixing thioacetamide with hexammino cobaltic chloride to form a light-sensitive complex capable of interacting with lead acetate to produce a lead sulfide image. Hickman et al, U.S. Pat. No. 1,962,307 issued June 12, 1934, teach mixing hexammine cobaltic chloride and citric acid to form a light-sensitive complex capable of bleaching a lead sulfide image. Weyde, U.S.

Pat. No. 2,084,420 issued June 22, 1937, teaches producing a latent image by exposing $Co(NH_3)_2$— $(NO_2)_4NH_4$ to light or an electrical current. A visible image can be formed by subsequent development with ammonium sulfide. U.S. Ser. No. 618,186 by Adin et al filed Sept. 30, 1975, commonly assigned, discloses that images can be produced by employing a cobalt(III) complex in combination with a photoreductant. U.S. Ser. No. 610,954 by Do Minh filed Sept. 8, 1975, commonly assigned, now abandoned and refiled Oct. 30, 1975, as U.S. Ser. No. 627,393 discloses imaging with cobalt(III) complexes where a compound is employed in combination which promotes an internal gain. U.S. Ser. No. 629,931 by Brault et al filed Nov. 7, 1975, commonly assigned, discloses imaging using cobalt(III) complexes in combination with spectral-sensitizing dyes. Generally cumulative disclosures also appear in *Research Disclosure,* Volume 126, Item 12617, published Oct., 1974; Volume 130, Item 13023, published Feb., 1975; and Volume 135, Item 13505, published July, 1975.

The formation of reversal dye images in photographic elements is generally old and well-known in the photographic arts. In a typical approach, a silver halide photographic element capable of forming a multicolor image is imagewise-exposed and developed in a black-and-white photographic developer composition. The undeveloped silver halide is next rendered developable by uniform exposure or by fogging. The undeveloped silver halide is then developed using a color-developing agent so that a positive dye image is formed. Reversal processing has proven quite attractive, since it offers a convenient approach for obtaining a positive dye image using a negative-working silver halide emulsion without the necessity of first producing a negative dye image and then re-exposing a second photographic element through the negative dye image. Reversal processing to form positive dye images is widely employed in producing color photographic transparencies.

The teaching of forming reversal dye images in photographic elements using redox amplification processing is disclosed by Bissonette, U.S. Pat. No. 3,862,842 issued Jan. 28, 1975, in connection with cobalt(III) complex oxidizing agents. In one approach, it is necessary to bleach and fix image silver generated during black-and-white development in order to avoid uniform dye generation and, in a second approach, more fully described by Bissonette, U.S. Ser. No. 606,999 filed Aug. 22, 1975, commonly assigned, it is necessary to release a silver poisoning agent to get imagewise formation of dye. Both of these processes then introduce additional complexities in manipulative processing or element structure onto conventional silver halide reversal processing.

The formation of positive or reversal dye images in connection with peroxide redox amplification is also known in the art. In U.S. Pat. No. 3,694,207 by Matejec et al issued Sept. 26, 1972, positive dye images are formed by providing a uniform coating of a peroxide redox catalyst on a photographic support. Upon imagewise exposure, the redox catalyst is destroyed in light-struck areas. In U.S. Pat. No. 3,776,730 by Matejec et al issued Dec. 4, 1973, a positive dye image is formed in a peroxide redox amplification process by imagewise-exposing a silver halide photographic element containing a negative-working emulsion. The emulsion is developed using a black-and-white developer to form a negative silver image. Upon treatment with peroxide, the peroxide is quickly decomposed in the areas containing the silver image, thereby leaving behind a peroxide distribution in the unexposed areas of the photographic element. By incorporating in the photographic element substances which will decompose the peroxide at a slower rate than the silver image, such as sulfides, selenides, hydroxides, hydrated oxides or oxides of manganese, among other listed materials, the residual peroxide in the unexposed areas can be slowly decomposed under conditions which promote the formation of a positive dye image.

SUMMARY OF THE INVENTION

In one aspect, my invention is directed to a method of forming a dye image. My process comprises forming an immobile cobalt complex image in an imaging layer of a photographic element and forming in the imaging layer an immobile catalytic manganese complex image which is a complement of the cobalt complex image. I then employ the immobile catalytic manganese complex image as a catalyst in a peroxide redox amplification reaction to form a dye image.

In a more specific aspect, my invention is directed to a method of forming a dye image comprising forming an immobile cobalt complex image in an element comprised of a support and, as a coating thereon, at least one layer comprised of a substantially uniform distribution of an agent capable of complexing with cobalt ions in preference to manganese ions and a radiation-responsive means capable of permitting an imagewise distribution of cobalt ions to be formed. A catalytic image is formed which is a reversal of the cobalt complex image by providing manganese ions in association with the complexing agent before or after the cobalt complex image is formed and removing manganese ions from the element layer not associated with the complexing agent after the cobalt and manganese complex images are formed to leave an immobile catalytic manganese image. A peroxide oxidizing agent and a reducing agent which upon oxidation provides a dye-image-generating reaction product are brought together in the presence of the immobile catalyst manganese complex image, wherein the peroxide oxidizing agent and the reducing agent are chosen so that they are essentially inert to oxidation-reduction in the absence of a catalyst. The peroxide oxidizing agent and the reducing agent are selectively reacted at the site of the immobile catalytic manganese complex image to permit a dye image to be formed which is a reversal of the image pattern of the cobalt complex.

My invention is considered advantageous in that it offers an approach for obtaining reversal dye images using an immobile manganese complex image as a catalyst for a peroxide redox amplification reaction. By process advances the state of the art by providing a way of obtaining positive dye images where only negative dye images have heretofore been obtained using manganese complexes to catalyze peroxide redox amplification reactions. Further, I achieve a significant advantage over the art in this combination by utilizing manganese complexes, which allow superior catalysis as compared with cobalt complexes which have been more widely recognized as useful in peroxide redox amplification reactions. I have recognized quite surprisingly that it is possible to obtain satisfactory dye images in peroxide redox amplification reactions even though complementary cobalt and manganese complex images are present in a photographic element being processed. This again is based on my recognition of the faster redox rate obtainable with manganese complex catalyst images. Another advantageous feature of my process is that it can be applied to photographic elements containing either silver halide or a cobalt(III) complex as a radiation-responsive material. Thus, my process can be practiced with a broad range of photographic elements of conventional structure. My invention is further quite versatile in being useful with photographic elements which either contain or do not contain manganese at the time of exposure. Because of the capability of my process to be applied to silver halide photographic elements and to employ a highly efficient redox amplification catalyst, my invention offers the capabilities of very high photographic speed and/or the opportunity to obtain relatively high photographic speeds through the use of very low levels of silver halide. Finally, I am able to achieve the advantages noted above through the use of a process which can be, from a manipulative viewpoint, quite simple as compared with conventional reversal processing techniques.

These and other advantages of my invention may be more readily appreciated by reference to the following detailed description of my invention in conjunction with the drawings, in which:

FIGS. 1 through 4 are schematic diagrams of photographic elements employed in the practice of my process as they would appear at various stages before, during and after processing, wherein the separate figures represent alternative species of my invention, and FIG. 5 is a schematic diagram similar to FIGS. 1 through 4, but illustrating the use of a receiver element in combination with a photographic element.

DETAILED DESCRIPTION OF INVENTION

While subheadings are provided for convenience, to appreciate fully the elements of my invention it is intended that my disclosure be read and interpreted as a whole.

As employed herein, the terms "complementary dye image" and "reversal dye image" are used synonymously to indicate images which are related to a reference image in the same way that corresponding photographic positive and negative images are related. The complementary or reversal image is positive when the reference image is negative and negative when the reference image is positive.

A NONSILVER IMAGING MANGANESE DISPLACEMENT APPROACH

Figure 1A:
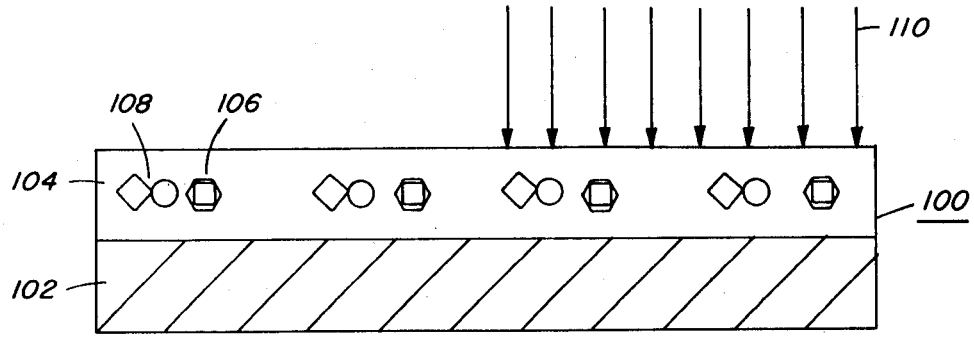

One technique for practicing my invention to form a dye image through peroxide redox amplification can be conveniently discussed by reference to FIG. 1. In FIG. 1*a* a photographic element 100 is disclosed comprised of a support 102 and a radiation-sensitive coating thereon 104. The radiation-sensitive coating is comprised of a cobalt(III) complex 106, schematically indicated, and an immobile catalytic manganese complex 108, also schematically indicated.

To form a dye image, the radiation-sensitive layer is imagewise-exposed to actinic radiation, indicated schematically by arrows 110. As is well-understood in the art, cobalt(III) complexes possess a native sensitivity to ultraviolet radiation. If it is desired to expose the cobalt(III) complex using visible radiation, this can be achieved using a suitable photoactivator in combination with the cobalt(III) complex. According to one approach, the photoactivator can be a spectral-sensitizing dye. Alternatively, the photoactivator can take the form of a photoreductant. Where a photoreductant is employed as a photoactivator for the cobalt(III) complex, it is necessary only that the photoreductant be present in the radiation-sensitive layer during exposure. Useful results can be achieved even if the cobalt(III) complex is not introduced until after imaging exposure. However, to preserve image definition, the cobalt(III) complex is preferably either initially present during exposure or introduced into the radiation-sensitive layer in solution immediately thereafter. Depending upon the specific choice of reactants, it may be desirable to accelerate reduction of the cobalt(III) complex, as by heating or by using other accelerating techniques.

Figure 1B:
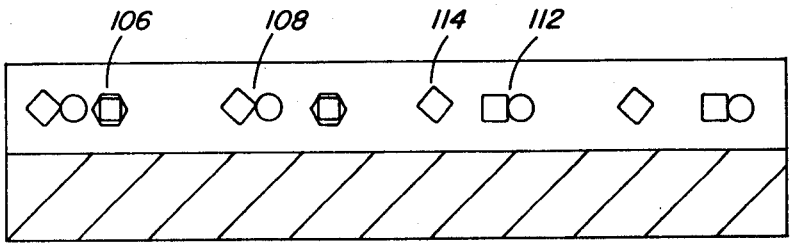

FIG. 1*b* schematically illustrates the distribution of reactants in the photographic element at the conclusion of imagewise cobalt(III) complex reduction. In the areas of the radiation-sensitive layer exposed to actinic radiation, the cobalt(III) is reduced to cobalt(II). The cobalt(II) displaces manganese from the manganese complex initially present in the radiation-sensitive layer to produce a new cobalt complex and displaced manganese, shown schematically as 112 and 114, respectively. The newly formed cobalt complex typically takes the form of an immobile cobalt complex, with the cobalt being in its plus 2, or cobalt(II), oxidation state. The displaced manganese is typically present in the form of mobile divalent ions. In the unexposed areas of the radiation-sensitive layer, schematically indicated as the left-hand half of the photographic element, no corresponding change in the radiation-sensitive layer has occurred and, in most instances, this portion of the radiation-sensitive layer is essentially unaltered.

Figure 1C:
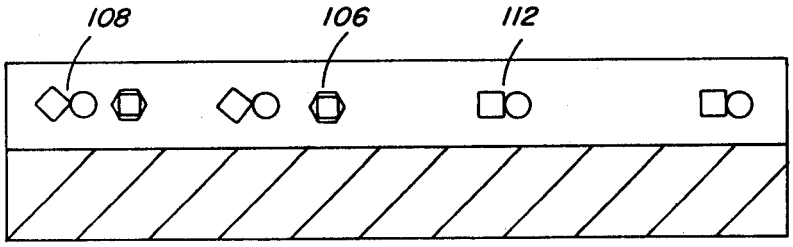

In FIG. 1*c*, the photographic element is schematically shown following removal of the displaced manganese. By contrast, the immobile manganese complex initially present in the photographic element is essentially undisturbed. Selective removal of the displaced manganese can be achieved merely by washing the photographic element. Where the displaced manganese is present in the form of divalent metal ions, it is quite water-soluble, whereas the manganese complex is at least substantially less soluble and, preferably, substantially insoluble in water. Although the initially present cobalt(III) complex is shown to be retained in the unexposed areas, some or all of this complex may be removed in removing the divalent manganese ions.

The photographic element in the form shown in FIG. 1*c* is next employed to form a dye image according to conventional peroxide redox amplification processing techniques. Specifically, a solution containing a peroxide oxidizing agent and a dye-image-generating reducing agent is brought into contact with the radiation-sensitive layer of the photographic element. The peroxide oxidizing agent and the reducing agent are chosen so that they are substantially incapable of entering into a redox reaction in the absence of a catalyst. The manganese catalyst which remains in the unexposed areas of the photographic element is capable of acting as a catalyst for the redox reaction. The manganese catalyst forms an image which is a reversal of the image-wise exposure of the radiation-sensitive layer and a reversal of the new cobalt complex image.

Figure 1D:
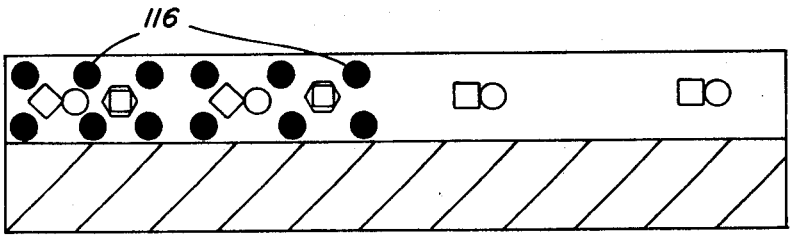

In FIG. 1*d*, the imaging dye 116 that is produced through the peroxide redox amplification reaction is shown schematically. The imaging dye defines an image pattern which corresponds to the manganese complex image pattern and which is complementary to the coextensive image patterns of the actinic radiation and the newly formed cobalt complex. The dye image is then a positive image. Although not shown in FIG. 1*d*, which is merely schematic, some dye may be formed also in the portion of the radiation-sensitive layer which was exposed to actinic radiation. Such dye will be formed in a lesser amount, however, resulting in a clear differentiation in the density levels of the exposed and unexposed areas of the photographic element. Where the newly formed cobalt complex is also catalytic, it may produce some dye in the exposed area; however, I have discovered that, by leaving the photographic element being processed in contact with the peroxide redox amplification solution only long enough to form the desired dye image in the unexposed areas, no more than a low level of dye density need be formed in exposed areas, even though the cobalt complex is also catalytic. Image discrimination in this instance is attributable to the much higher degree of catalytic activity exhibited by manganese as compared with cobalt, which results in a much faster rate of redox dye formation.

A NONSILVER IMAGING MANGANESE IMBIBITION APPROACH

Figure 2A:
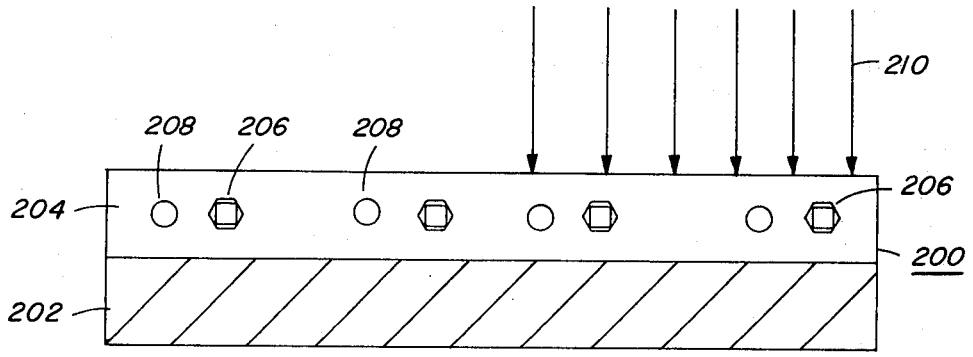

An alternative technique for forming a dye image through peroxide redox amplification using my invention can be conveniently discussed by reference to FIG. 2. In FIG. 2*a*, a photographic element 200 is shown comprised of a support 202 and a radiation-sensitive coating thereon 204. The radiation-sensitive coating is comprised of a cobalt(III) complex 206, schematically indicated, and a complexing agent 208. The complexing agent is chosen from among those capable of complexing with either cobalt or manganese ions.

To form a dye image, the radiation-sensitive layer is imagewise-exposed to actinic radiation, indicated schematically by arrows 210. Exposure and response of photographic element 200 can be identical with that described above for photographic element 100. The significant difference in this embodiment is that the cobalt produced by exposure reacts with the complexing agent to form a new cobalt complex, typically a cobalt(II) complex, without any necessity for displacing manganese from coordination with the complexing agent.

Figure 2B:
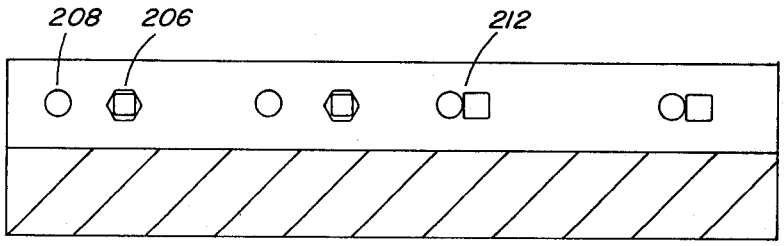

The photographic element following exposure is shown in FIG. 2*b*, wherein the newly formed cobalt complex 212 is schematically indicated. Again, the unexposed portion of the photographic element is substantially undisturbed. The new cobalt complex forms an image pattern corresponding to the image pattern of exposure.

Formation of a reversal or manganese image pattern can be achieved by imbibing or ingesting manganese ions into the radiation-sensitive layer. This can be achieved by bringing the photographic element into a solution containing a soluble manganese salt. Where the complexing agent has not already formed a complex with cobalt, the manganese will react with the complexing agent to form a manganese complex, indicated schematically in FIG. 2*c* by reference numeral 214. In the exposed areas of the element no available complexing agent is present and the imbibed manganese remains in its soluble, mobile from 216.

Figure 2C:
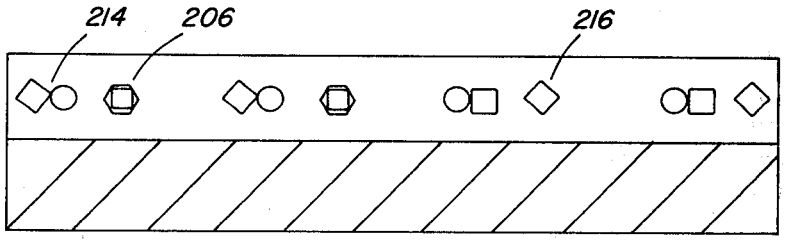
Figure 2D:
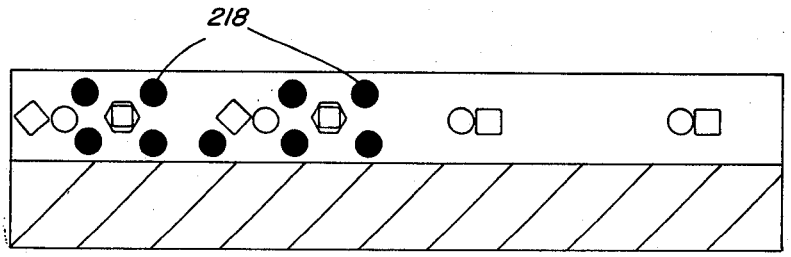

The photographic element in the form shown in FIG. 2*c* can be washed to remove uncomplexed, mobile manganese, as described in processing element 100, but this is not required. Instead, the photographic element can be placed directly in a peroxide redox amplification solution, as described in connection with FIG. 1. The mobile manganese ions migrate out of the photographic conductive element into the redox amplification solution before they can catalyze any significant amount of dye formation. Of course, washing the photographic element before introducing it into the redox amplification solution will obviate entirely any risk of forming image dye in background areas by manganese catalysis. As shown in FIG. 2*d*, image dye is formed in unexposed areas similarly as in photographic element 100. Thus, generally comparable results can be achieved using either displacement or imbibition techniques.

A SILVER IMAGING MANGANESE IMBIBITION APPROACH

The application of my process to a silver halide photographic element can best be appreciated by reference to FIG. 3. In FIG. 3*a*, a photographic element 300 is shown comprised of a support 302 and a radiation-sensitive layer 304. The radiation-sensitive layer contains silver halide grains, typically suspended to form a photographic emulsion. In the area of the photographic element where the radiation-sensitive layer is exposed to actinic radiation, indicated schematically by arrows 306, the silver halide grains 308*a* bear a latent image, while in the unexposed areas the silver halide grains 308*b* do not contain a latent image. In addition to the silver halide grains the radiation-sensitive layer contains a complexing agent 310, which can be identical to complexing agent 208. The radiation-sensitive layer is also shown to include an incorporated color coupler 312.

Figure 3A:
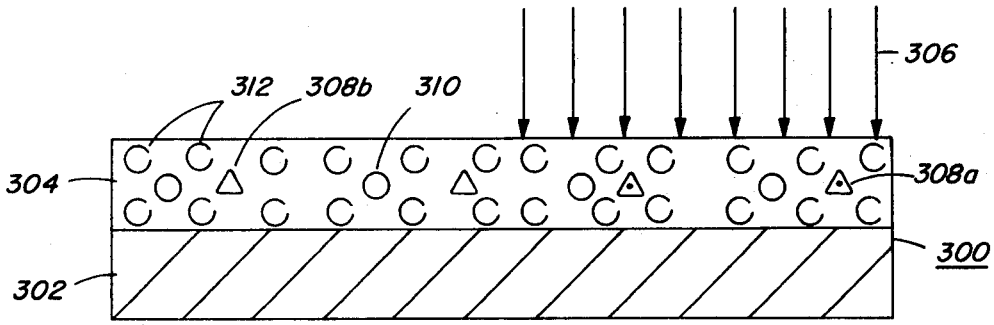
Figure 3B:
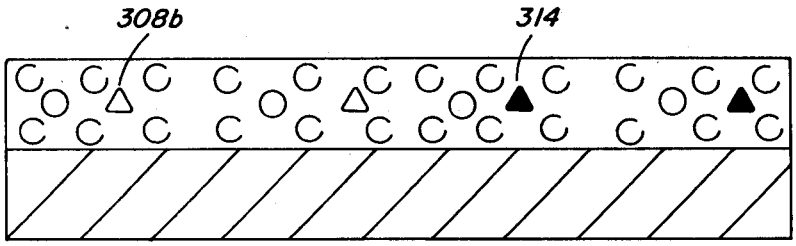

Following exposure, a silver image can be produced in exposed areas by conventional processing techniques used to form a silver image in silver halide reversal processing. Typically, this includes developing the silver halide grains bearing the latent image to form silver 314 in its place. This is done with a black-and-white developer to avoid forming a dye image. The phtographic element bearing the silver image is shown in FIG. 3*b*. In view of the amplification achievable with my process, it is not essential that the silver levels of conventional reversal processing be present. It is to be noted that the incorporated color coupler and the complexing agent are essentially undisturbed by silver imaging.

Figure 3C:
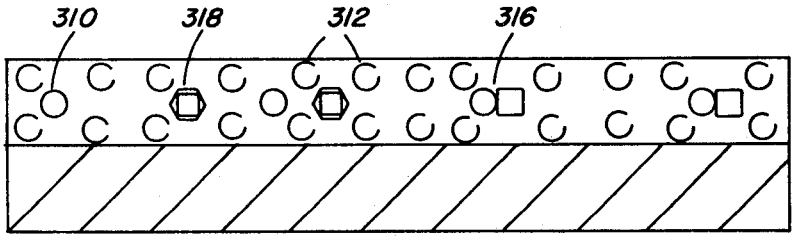

The next step of the process is to remove the silver halide and silver from the photographic element through bleaching and fixing and to replace the silver image with a corresponding cobalt complex image formed by complexing cobalt ions with the complexing agent initially in the photographic element. This can be accomplished by employing a conventional bleach-fix solution containing a cobalt(III) complex. In the areas containing silver, the cobalt(III) complex bleaches silver. Cobalt ions are formed by reduction and complex with the initially present complexing agent. Typically, a cobalt(II) complex is formed. In the unexposed areas, the cobalt(III) complex is not decomposed and may remain in the photographic element. This is illustrated in FIG. 3*c*, wherein the cobalt complex formed by bleaching image silver is indicated at 316 and the cobalt(III) complex incorporated in the bleach-fix solution remaining in the element is indicated at 318. In the unexposed areas the originally present complexing agent is substantially undisturbed by bleaching and fixing. Similarly, the incorporated coupler is not disturbed.

Figure 3D:
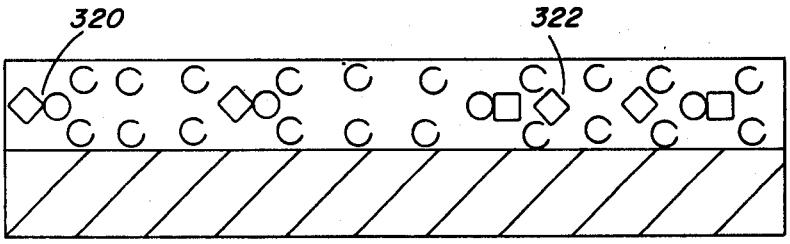

Referring to FIG. 3*d*, a manganese complex 320 forms an immobile catalytic image which is a complement of the imagewise-exposure pattern and the newly formed cobalt complex image pattern. The manganese complex image can be formed merely by imbibing a manganese salt solution into the radiation-sensitive layer, as disclosed in connection with photographic element 200. In imagewise-exposed areas no complexing agent remains available because of formation of the cobalt complex, so that only mobile manganese 322 is present. The cobalt(III) complex used in bleaching and fixing is not shown in FIG. 3*d*, as it may be leached from the photographic element during manganese ingestion, although this is not necessary. The incorporated color coupler remains essentially undisturbed.

Figure 3E:
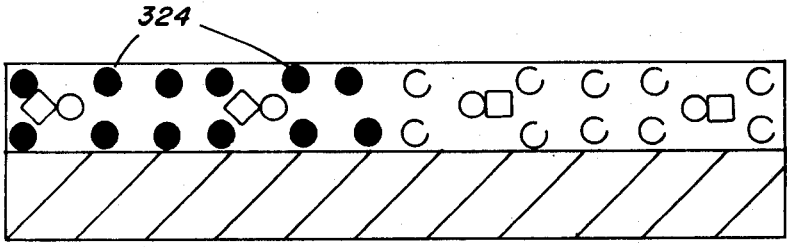

To form a positive or reversal dye image in the photographic element, it is merely necessary to bring the element into contact with a peroxide redox amplification solution. Since the element contains an incorporated color coupler, the dye-image-generating reducing agent employed is preferably a color-developing agent which, upon oxidation by the peroxide oxidizing agent, reacts or couples with the color coupler to form a dye image, indicated in FIG. 3*e* schematically at 324. Except for the variation in the use of an incorporated color coupler, peroxide redox amplification to form a dye image in photographic element 300 can be identical with that described above in connection with photographic element 200.

A SILVER IMAGING MANGANESE DISPLACEMENT APPROACH

An alternative approach for applying my process to a silver halide photographic element can best be appreciated by reference to FIG. 4. In FIG. 4*a*, a photographic element 400 is shown comprised of a support 402 and a radiation-sensitive layer 404. The radiation-sensitive layer contains silver halide grains, preferably present in the form of a photographic emulsion, which can be identical with those of phtographic element 300. The significant difference between radiation-sensitive layers 304 and 404 is that the latter contains a manganese complex 406. In the area of the photographic element which the radiation-sensitive layer is exposed to actinic radiation, indicated schematically by arrows 408, the silver halide grains 410*a* bear a latent image, while in the unexposed areas the silver halide grains 410*b* do not contain a latent image.

Figure 4A:
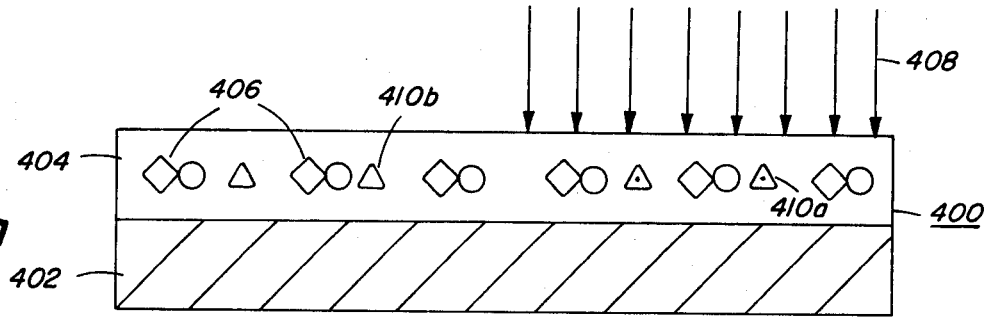
Figure 4B:
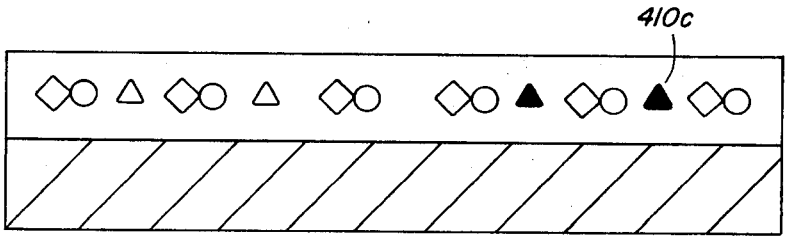

Following exposure, a silver image can be developed following procedures similar to those described above for photographic element 300. As shown in FIG. 4*b*, the silver image is schematically indicated by silver grains 410*c*.

Figure 4C:
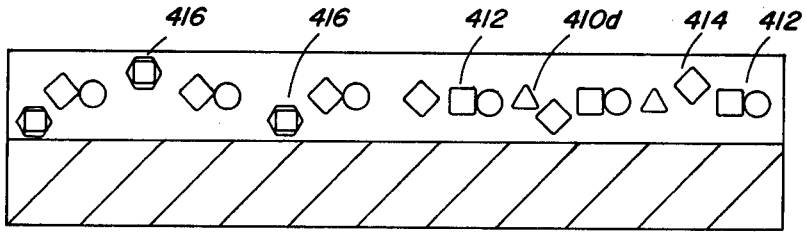
Figure 4D:
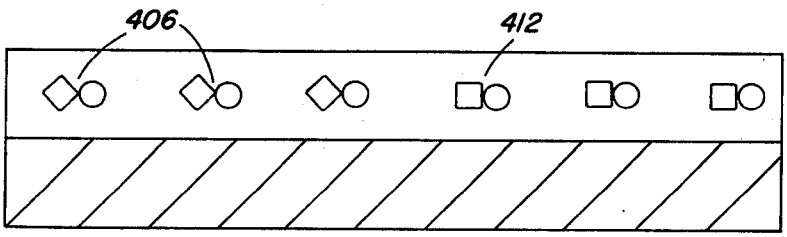

Using a cobalt(III) complex containing bleaching agent, the silver image can be reconverted to silver halide grains 410*d*, shown in FIG. 4*c*. The reduced cobalt formed by bleaching, typically cobalt(II), then displaces manganese from the manganese complex to form a new cobalt complex 412 in imagewise-exposed areas. This leaves mobile manganese ions 414 in the imagewise-exposed areas and the cobalt(III) complex 416 in unexposed areas. The manganese complex in unexposed areas is essentially undisturbed. As shown in FIG. 4*d*, the mobile manganese ions, as well as the cobalt(III) complex and the silver halide, can all be removed from the photographic element in a conventional fixing bath. This leaves in the element a cobalt complex 412 in imagewise-exposed areas and a reversal manganese complex image in unexposed areas.

Figure 4E:
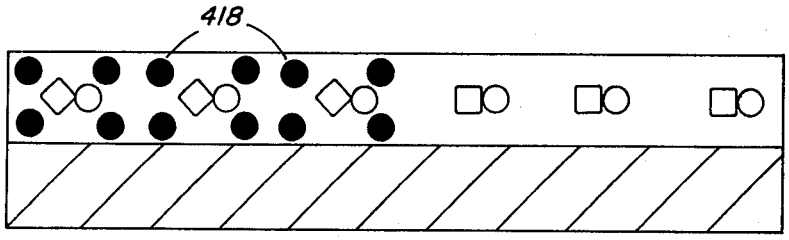

To form a dye image in the unexposed area of the photographic element corresponding to the manganese complex image and complementing the image pattern of the cobalt complex and expousre, it is merely necessary to bring the photographic element into contact with a peroxide redox amplification bath. The image dye produced is schematically shown in FIG. 4*e* at 418. Redox amplification can be identical with that described in connection with FIGS. 1 and 2.

OTHER VARIANT APPROACHES

It is to be recognized that the four separate approaches to the practice of my process outlined with reference to FIGS. 1 through 4 are merely exemplary of a number of alternative approaches which can be employed in the practice of my invention. For example, manganese ions displaced or introduced by imbibition and not complexed can be removed by washing prior to resox amplification in all of the above embodiments or omitted from all. Similarly, cobalt(III) complex can be washed from the elements in all instances before redox amplification or can be allowed to remain in all the elements. While only photographic element 300 is shown to include an incorporated color coupler, such couplers could, if desired, be included in photographic elements 100, 200 and 400 or, if desired, be omitted from element 300. In the silver halide elements, bleaching and fixing of the silver and silver halide can be concurrently performed in both silver halide embodiments illustrated. Alternatively, in either embodiment the silver image can be merely bleached without fixing the silver halide, since this is all that is required to form the cobalt(II) complex desired. While I have described the practice of my processes in terms of a pure displacement approach or a pure imbibition approach, it is apparent that some manganese complex can be originally in the photographic elements and that more can be provided later by imbibition, if desired.

Figure 5A:
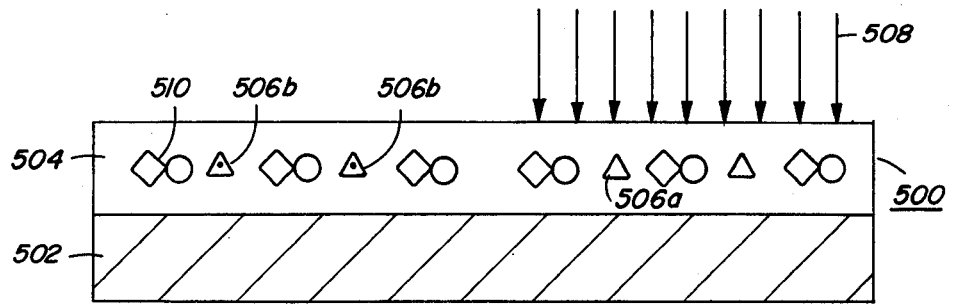

To illustrate further the variant forms of invention, reference is made to FIG. 5, wherein a photographic element 500 is shown in FIG. 5*a* comprised of a support 502 and a radiation-sensitive layer 504. The radiation-sensitive layer is similar to that of photographic element 400, except that the silver halide grains are chosen to be positiveworking; that is, the silver halide grains 506*a* lying in the area of exposure, indicated by arrows 508, are rendered nondevelopable by exposure, whereas the silver halide grains 506*b* are developable without being imagewise-exposed. The manganese complex 510 can be identical with manganese complex 406.

Figure 5B:
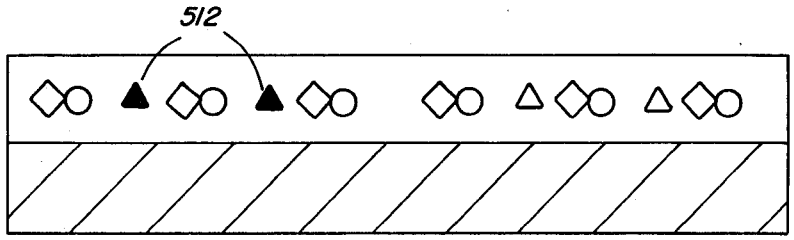

Upon development, a silver image, indicated schematically at 512 in FIG. 5*b*, is formed in unexposed areas while the imagewise-exposed silver halide grains are not developed. Thus, a silver image is formed which is a postive of the exposure image.

Figure 5C:
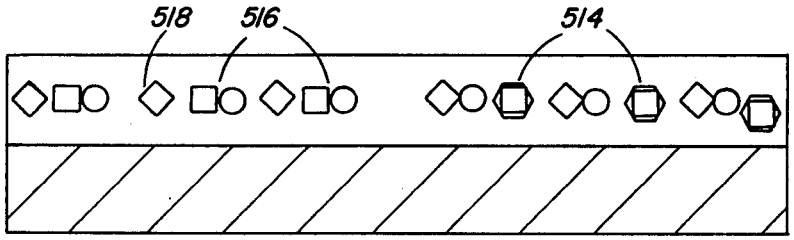

Upon bleaching and fixing with a cobalt(III) complex 514 as shown in FIG. 5*c*, both silver and silver halide are removed from the photographic element. A new cobalt complex 516 is formed in the unexposed area by displacement of manganese from the manganese complex to leave mobile ions 518. In exposed areas, the original manganese complex is left undisturbed and the cobalt(III) complex ingested remains unreacted.

Figure 5D:
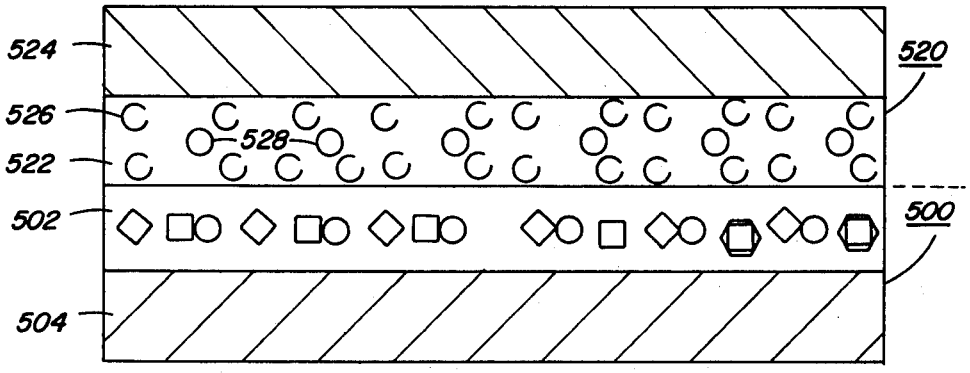

To form an image, a receiver element 520, shown in FIG. 5*d*, comprised of a receiver layer 522 on a support 524 can be positioned so that the receiver layer contacts the radiation-sensitive layer of the photographic element. The receiver layer is shown to be comprised of an incorporated color coupler 526 and a complexing agent 528. The receiver layer can be substantially identical to the radiation-sensitive layer 304, except for the omission of silver halide. Upon placing the receiver layer and the radiation-sensitive layer in contact, the mobile manganese ions are free to migrate into the receiver layer and to form a manganese complex with the complexing agent.

Figure 5E:
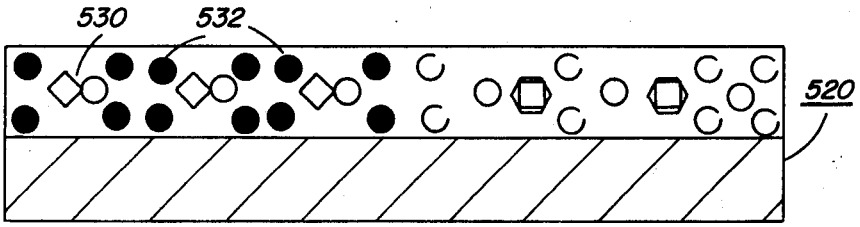

Referring to FIG. 5e, the receiver element, containing the manganese complex 530 in an image pattern which is a complement of the image pattern of exposure of the photographic element, can be brought into contact with a redox amplification solution to form a dye image, schematically indicated at 532, corresponding to the manganese complex image. The dye image formed in the receiver is a positive of the exposure image.

The above description of forming an image according to the process referred to FIG. 5 illustrates the practice of my process in using a positive-working silver halide emulsion as an alternative to using a negative-working emulsion. This embodiment further illustrates the applicability of my process to image transfer. Since a manganese complex image is formed in the photographic element 500 corresponding to the exposed areas, it is apparent that a negative dye image could be formed in the photographic element instead of or as well as forming a positive image in the receiver element. While only the receiver element is shown to include an incorporated color coupler, both the photographic and receiver elements or neither can contain a color coupler. Where it is intended to form an image in the photographic element, only this element need contain a coupler.

From the foregoing description, it is apparent that the practice of my process is adaptable to a number of alternative approaches and that other variations will readily occur to those skilled in the art who are apprised of my invention.

THE PHOTOGRAPHIC ELEMENTS

The supports employed in the photographic and receiver elements described above can take any convenient conventional form. I prefer to employ conventional photographic supports, such as paper or film supports, such as resin-coated paper supports and cellulose triacetate and poly(ethylene terephthalate) film supports. Other exemplary conventional photographic supports are disclosed in *Product Licensing Index,* Volume 92, December, 1971, publication 9232, paragraph X, here incorporated by reference.

Excluding the complexing agent and the manganese complex for discussion below, the radiation-sensitive layers can be of conventional composition. Considering first the radiation-sensitive layers of the photographic elements 100 and 200, the cobalt(III) complexes, as well as the binders employed therewith, can take any of the conventional forms disclosed in U.S. Pat. Nos. 1,897,843, 1,962,307 and 2,084,420, as well as *Research Disclosure,* Volume 126, Item 12617, Volume 130, Item 13032, and Volume 135, Item 13505, cited above, here incorporated by reference. Since the photographic elements are preferably processed in aqueous solutions, I prefer to use as binders the vehicles conventionally employed in forming silver halide emulsion layers in photographic elements. These binders are water-permeable materials, such as hydrophilic colloids like gelatin. Suitable vehicles of this type are disclosed in *Product Licensing Index,* publication 9232, cited above, paragraph VIII, here incorporated by reference.

The cobalt(III) complexes incorporated in the radiation-sensitive layer are those which feature a molecular having a cobalt atom or ion surrounded by a group of atoms, ions or other molecules which are generically referred to as ligands. The cobalt atom or ion in the center of these complexes is a Lewis acid, while the ligands are Lewis bases. While it is known that cobalt is capable of forming complexes in both its cobalt(II) and cobalt(III) oxidation states, only complexes of cobalt(III) are employed in the practice of this invention, since the ligands are tenaciously held in these complexes as compared with corresponding cobalt(II) complexes. Preferred cobalt(III) complexes are those which are inert. Inert complexes are defined as those which, when a test sample thereof is dissolved at 0.1 molar concentration at 20° C. in an inert solvent solution also containing a 0.1 molar concentration of a tagged uncoordinated ligand of the same species as the coordinated ligand, exhibit essentially no exchange of uncoordinated and coordinated ligands for at least 1 minute, and preferably for at least several hours, such as up to 5 hours or more. This test is advantageously conducted under the conditions existing within the radiation-sensitive elements of this invention. Many cobalt(III) complexes show essentially no exchange of uncoordinated or coordinated ligands for several days. The definition of inert complexes and the method of measuring ligand exchange using radioactive isotopes to tag ligands are well-known in the art. See, for example, Taube, *Chem. Rev.,* Vol. 50, p. 69 (1952), and Basolo and Pearson, *Mechanisms of Inorganic Reactions, A Study of Metal Complexes and Solutions,* 2nd Edition, 1967, published by John Wiley and Sons, p. 141. Further details on measurement of ligand exchange appear in articles by Adamson et al, *J. Am. Chem.,* Vol. 73, p. 4789 (1951).

Preferred cobalt(III) complexes useful in the practice of this invention are those having a coordination number of 6. A wide variety of ligands can be used with cobalt(III) to form cobalt(III) complexes. Nearly all Lewis bases (i.e., substances having an unshared pair of electrons) can be ligands in cobalt(III) complexes. Some typical useful ligands include halides (e.g., chloride, bromide, fluoride), nitrate, nitrite, superoxide, water, amines (e.g., ethylenediamine, n-propylenediamine, diethylenetriamine, triethylenetetraamine, diaminodiacetate, ethylenediaminetetraacetic acid, etc.), ammine, azide, glyoximines, thiocyanate, cyanide, carbonate, and similar ligands, including those referred to on page 44 of Basolo et al, supra. It is also contemplated to employ cobalt(III) complexes incorporating as ligands Schiff bases, such as those disclosed in German OLS publications 2,052,197 and 2,052,198.

The cobalt(III) complexes useful in the practice of this invention can be neutral compounds which are entirely free from either anions or cations. The cobalt(III) complexes can also include one or more cations and anions as determined by the charge neutralization rule. Useful cations are those which produce readily solubilizable cobalt(III) complexes, such as alkali and quaternary ammonium cations. The anions can be chosen from among conventional compatible anions, such as halides (e.g., chloride, bromide, fluoride, etc.), sulfite, sulfate, alkyl or aryl sulfonates, nitrate, nitrite, perchlorate, carboxylates (e.g., halocarboxylates, acetate, hexanoate, etc.), hexafluorophosphate, tetrafluoroborate, and other similar anions.

Exemplary preferred cobalt(III) complexes for incorporation in the radiation-sensitive layer of the photographic element can be chosen from among those set forth below in Table I.

Table I

| Exemplary Preferred Cobalt(III) Complexes | |
|---|---|
| C-1 | hexa-ammine* cobalt(III) acetate |
| C-2 | hexa-ammine cobalt(III) thiocyanate |
| C-3 | hexa-ammine cobalt(III) trifluoroacetate |
| C-4 | chloropenta-ammine cobalt(III) bromide |
| C-5 | bromopenta-ammine cobalt(III) bromide |
| C-6 | aquopenta-ammine cobalt(III) nitrite |
| C-7 | bis(ethylenediamine) di-ammine cobalt(III) perchlorate |
| C-8 | bis(ethylenediamine) diacetato cobalt(III) chloride |
| C-9 | triethylenetetramine dichloro cobalt(III) acetate |
| C-10 | bis(methylamine) tetra-ammine cobalt(III) hexafluorophosphate |
| C-11 | aquopenta(methylamine) cobalt(III) nitrate |
| C-12 | chloropenta(ethylamine) cobalt(III) chloride |
| C-13 | trinitrotris-amine cobalt(III) |
| C-14 | trinitrotris(methylamine) cobalt(III) |
| C-15 | tris(ethylenediamine) cobalt(III) acetate |
| C-16 | tris(1,3-propanediamine) cobalt(III) trifluoroacetate |
| C-17 | bis(dimethylglyoxime) bispyridine cobalt(III) trichloroacetate |
| C-18 | N,N'-ethylenebis(salicylideneimine) bis-ammine cobalt(III) bromide |
| C-19 | bis(dimethylglyoxime) ethylaquo cobalt(III) |
| C-20 | superoxodeca-ammine dicobalt(III) perchlorate |
| C-21 | sodium dichloro ethylenediamine diaceto cobalt(III) |
| C-22 | penta-ammine carbonato cobalt(III) nitrite |
| C-23 | tris(glycinato) cobalt(III) |
| C-24 | trans[bis(ethylenediamine) chlorothiocyanato cobalt(III)] sulfite |
| C-25 | trans[bis(ethylenediamine diazido cobalt(III) chloride |
| C-26 | cis[bis(ethylenediamine) ammine azido cobalt(III) hexanoate |
| C-27 | tris(ethylenediamine) cobalt(III) chloride |
| C-28 | trans[bis(ethylenediamine) dichloro cobalt(III)] chloride |
| C-29 | bis(ethylenediamine) dithiocyanato cobalt(III) fluoride |
| C-30 | triethylenetetramine dinitro cobalt(III) iodide |
| C-31 | tris(ethylenediamine) cobalt(III) 2-pyridylcarboxylate |

*also referred to as hexammine

The cobalt(III) complexes are generally directly responsive to electromagnetic radiation of a wavelength less than 300 nm. In order to initiate reduction of the cobalt(III) complexes in response to actinic radiation of a wavelength longer than 300 nm., it is preferred to incorporate into the radiation-sensitive coating a photoactivator. One class of photoactivators is comprised of spectral-sensitizing dyes. The spectral-sensitizing dyes can be chosen from among the classes of spectral sensitizers known to be useful with silver halide, such as acridines, anthrones, cyanines, merocyanines, styryl and styryl base dyes, polycyclic hydrocarbon dyes, ketone dyes, nitro dyes, oxonols (including hemioxonols), sulfur dyes, triphenylmethane dyes, xanthene dyes, etc. Specific illustrative spectral-sensitizing dyes are disclosed in 130 RD 13023, cited above.

Where the sensitizing dye is capable of forming a cationic or anionic moiety containing the chromophoric structure, it can be combined with the cobalt(III) complex as a cation or anion associated with the complex. While generally mixing the cobalt(III) complex and the dye produces useful results, ionically relating the cobalt(III) complex and the dye, as where the cobalt(III) complex forms a cationic moiety and the dye an anionic moiety, further insures intimate association of these components and enhances spectral sensitization.

Preferred spectral sensitizers for use in the practice of this invention are those having an anodic polarographic half-wave potential (also referred to as a ground state oxidation potential) which is less than 1 volt. It is further preferred that the spectral sensitizers be chosen so that the sum of the cathodic polarographic half-wave potential (also referred to as a ground state reduction potential) and the anodic polarographic half-wave potential is more negative than −0.50 volt.

As used herein and in the claims, polarographic measurements are made in accordance with the following procedure. Cathodic half-wave values are obtained against an aqueous silver-silver chloride reference electrode for the electrochemical reduction of the test compound using controlled-potential polarographic techniques. A $1 \times 10^{-4}$ M methanol solution of the test compound is prepared. The solvent is 100 percent methanol, if the compound is soluble therein. In some instances, it is necessary to use mixtures of methanol and another solvent, e.g., water, acetone, dimethylformamide, etc., to prepare the $1 \times 10^{-4}$ M solution of the test compound. There is present in the test solution, as supporting electrolyte, 0.1 M lithium chloride. Only the most positive (least negative) half-wave potential value observed is considered, and it is designated herein as the ground state reduction potential (or simply the reduction potential). Anodic half-wave values are determined against an aqueous silver-silver chloride reference electrode for the electrochemical oxidation of the tested compounds at a pyrolytic graphite electrode, and are obtained by controlled-potential voltammetry using solutions identical to those used to determine the cathodic polarographic values. Only the most negative (least positive) half-wave potential observed is utilized, and it is designated herein as the ground state oxidation potential. In both measurements, the reference electrode (aqueous silver-silver chloride) is maintained at 20° C. Signs are given according to the recommendation of IUPAC at the Stockholm Convention, 1953. The well-known general principles of polarographic measurements are used. See Kolthoff and Lingane, Polarography, Second Edition, Interscience Publishers, New York (1952). The principles of controlled-potential electrochemical instrumentation which allow precise measurements in solvents of low conductivity are described by Kelley, Jones and Fisher, *Anal. Chem.*, 31, 1475 (1959). The theory of potential sweep voltammetry such as that employed in obtaining the anodic determination is described by Dalahay, *New Instrumental Methods in Electrochemistry,* Interscience Publishers, New York, (1954), and Nicholson and Shain, *Anal. Chem.*, 36, 706 (1964). Information concerning the utility and characteristics of the pyrolytic graphite electrode is described by Chuang, Fried and Elving, *Anal. Chem.*, 36, (1964).

Illustrative of specific preferred spectral sensitizers are those listed below in Table II. Where an oxidizable anion, such as iodide, is associated with the dye, potential measurements were taken with a chloride or p-toluenesulfonate anion being substituted.

Table II

| Exemplary Preferred Spectral Sensitizers | | | |
|---|---|---|---|
| | | Ground State Potentials (volts) | |
| | | Oxidation | Reduction |
| SS-1 | 1,1'-diethyl-2,2'-carbocyanine iodide | +0.58 | −1.11 |
| SS-2 | 1,1'-diethyl-2,2'-dicarbocyanine | +0.27 | −0.98 |

Table II-continued

Exemplary Preferred Spectral Sensitizers

| | | Ground State Potentials (volts) | |
|---|---|---|---|
| | | Oxidation | Reduction |
| | iodide | | |
| SS-3 | 1,1',2,2'-tetrahydro-(4H-[1,4]thiazino-[3,4-b]benzothiazolo)cyanine bromide | +0.40 | −1.03 |
| SS-4 | 3-carboxymethyl-5-[(3-ethyl-2-benzothiazolinylidene)ethylidene]rhodanine | +0.5 | −1.4 |
| SS-5 | bis[3-methyl-1-phenyl-2-pyrazoline-5-one-(4)]trimethinoxonol, sodium salt | +0.37 | −1.16 |
| SS-6 | bis[3-methyl-1-phenyl-2-pyrazoline-5-one-(4)]pentamethinoxonol, sodium salt | +0.27 | −1.1 |
| SS-7 | anhydro-3,3'-di(2-carboxyethyl)oxadicarbocyanine hydroxide | +0.5 | −1.2 |
| SS-8 | 4-[(3-ethyl-2-benzothiazolinylidene)-isopropylidene]-3-methyl-1-(n-sulfophenyl-2-pyrazoline-5-one | +0.6 | −1.26 |
| SS-9 | 4-[(1-ethyl-2-naphtho-[1,2-d]thiazolinylidene)ethylidene]-3-methyl-1-(p-sulfophenyl)-2-pyrazoline-5-one | +0.48 | −1.31 |
| SS-10 | 3-carboxymethyl-5-[(3-ethyl-2-benzoxazolinylidene)ethylidene]rhodanine | +0.56 | −1.16 |
| SS-11 | 3-carboxymethyl-5-[(3-ethyl-2-benzoxazolinylidene)ethylidene]-2-thio-2,4-oxazolidenedione | +.63 | −1.48 |
| SS-12 | 3-carboxymethyl-5-[(3-methyl-2-thiazolidinylidene)isopropylidene]rhodanine | +.33 | −1.47 |
| SS-13 | 1-carboxymethyl-4-[(3-ethyl-2-benzoxazolinylidene)ethylidene]-3-phenyl-2-thiohydantoin | +.28 | −1.50 |
| SS-14 | 3-ethyl-5-[1-(4-sulfobutyl)-4-(1H)-pyridylidene]rhodanine sodium salt | +.42 | −1.70 |
| SS-15 | 3-carboxymethyl-5-(3-methyl-2-benzoxazolinylidene)rhodanine | +.89 | −1.76 |
| SS-16 | 3-ethyl-5-(1-ethyl-4(1H)-pyridylidene)-rhodanine | +.56 | −1.68 |
| SS-17 | anhydro-9-ethyl-3,3'-(3-sulfopropyl)-4,5,4',5'-dibenzo-e hydroxide, sodium salt | +0.60 | −1.3 |
| SS-18 | 3-ethyl-5-[(3-ethyl-2-benzoxazolinylidene)ethylidene]rhodanine | +0.60 | −1.37 |
| SS-19 | 3-ethyl-5-[(3-ethyl-2-benzothiazolinylidene)ethylidene]rhodanine | +0.57 | −1.27 |
| SS-20 | 5,5',6,6'-tetrachloro-1,1',3,3'-tetraethylbenzimidazolo carbocyanine chloride | +0.58 | −1.50 |
| SS-21 | anhydro-3-ethyl-9-methyl-3'-(3-sulfobutyl)thiacarbocyanine hydroxide | +0.73 | −1.28 |
| SS-22 | anhydro-9-methyl-3,3'-di(3-sulfobutyl)-thiacarbocyanine hydroxide | +0.72 | −1.28 |
| SS-23 | 3-ethyl-5-[(3-ethyl-2-benzoxazolinylidene)ethylidene]-1-phenyl-2-thiohydantoin | +0.49 | −1.47 |
| SS-24 | 3,3'-diethyl-4'-methyloxathiazolocarbocyanine bromide | +0.63 | −1.14 |
| SS-25 | 2-p-diethylaminostyrylbenzothiazole | +0.64 | −1.54 |
| SS-26 | 5,5'-dichloro-3,3'-9-triethylthiacarbocyanine bromide | +0.87 | −1.06 |
| SS-27 | anhydro-5,5'-dichloro-3,9-diethyl-3'-(3-sulfobutyl)thiacarbocyanine hydroxide | +0.86 | −1.15 |
| SS-28 | 2-diphenylamino-5-[(3-ethyl-2-benzoxazolinylidene)ethylidene]-2-thiazolin-4-one | +0.51 | −1.48 |
| SS-29 | 2-diphenylamino-5-[(3-ethyl-2-benzothiazolinylidene)ethylidene]-2-thiazolin-4-one | +0.46 | −1.36 |
| SS-30 | 1-p-carboxyphenyl-5-[(3-ethyl-2-benzoxazolinylidene)ethylidene]-3-phenyl-2-thiohydantoin | | |
| SS-31 | 4-(2,4-dinitrobenzylidene)-1,4-dihydro-1-(4-sulfobutyl)quinoline, sodium salt | | |
| SS-32 | 5-[(3-ethylnaphth-[2,1-d]oxazolin-2-ylidene)ethylidene]-3-heptyl-1-phenyl-2-thiohydantoin | | |
| SS-33 | 5-[4-(3-ethyl-2-benzothiazolinylidene)-2-butenylidene]-3-heptyl-1-phenyl-2-thiohydantoin | +0.21 | −1.22 |
| SS-34 | 3,3'-dimethyl-9-phenyl-4,5-4'-5'-dibenzothiacarbocyanine bromide | +0.63 | −1.29 |
| SS-35 | N,N'-di[2-p-sodiosulfoanilino-4-diethanolamino-1,3,5-triazyinyl(6)]-diaminostilbene-2,2'-disulfonic acid, sodium salt | +0.8 | more negative than −1.90 |
| SS-36 | N,N'-di[4-diethylamino-6-(2,5-disulfoanilino)]-2-s-triazinylamino-2,2'-stilbene disulfonic acid, hexasodium salt | +0.83 | more negative than −1.90 |
| SS-37 | hematoporphrin | | |
| SS-38 | fluorescein disodium salt | | |
| SS-39 | 4-methyl-7-diethylaminocoumarin | | |
| SS-40 | 4,6-dimethyl-7-ethylaminocoumarin | | |

It is possible to use photoreductants instead of or in combination with spectral-sensitizing dyes as photoactivators for the cobalt(III) complexes contained within the radiation-sensitive layer. Photoreductants are materials capable of molecular photolysis or photoinduced rearrangement to generate a reducing agent, which forms a redox couple with the cobalt(III) complex. The reducing agent spontaneously, or with the application of heat, reduces the cobalt(III) complex. Useful photoreductancts can be chosen from among conventional classes of photoreductants, such as quinone, disulfide, diazoanthrone, diazonium salt, diazophenanthrone, aromatic azide, acyloin, aromatic ketone, aromatic carbazide, diazosulfonate, aziridine and 2H-benzimidazole photoreductants. The photoreductants vary somewhat from class in their mechanism for forming useful reducing agents. Quinones which contain labile hydrogen atoms, that is, internal hydrogen source quinones, respond directly upon exposure to light to form useful reducing agents. In order to form dihydrobenzimidazole photoreductants, 2H-benzimidazoles must, however, be exposed in the presence of labile hydrogen atoms. By contrast, 1,3-diazabicyclo[3.1.0]hex-3-enes (aziridines) form a reducing agent precursor upon exposure and a reducing agent upon heating.

A particularly preferred class of photoreductants is that of internal hydrogen source quinones, that is, quinones incorporating labile hydrogen atoms. Particularly preferred internal hydrogen source quinones are 5,8-dihydro-1,4-naphthoquinones having at least 1 hydrogen atom in each of the 5- and 8-ring positions. Other preferred incorporated hydrogen source quinones are those which have a hydrogen atom bonded to a carbon atom to which is also bonded the oxygen atom of an oxy substitutent or a nitrogen atom of an amine substituent with the further provision that the carbon-to-hydrogen bond is the third or fourth bond removed from at least one quinone carbonyl double bond. For purposes of this definition the term "amine substituent" is inclusive of amide and imine substituents. Both 1,4-benzoquinones and 1,4-naphthoquinones which are substituted to have labile hydrogen atoms, as indicated above, have been found to form outstanding photoreductants.

Specific illustrative internal hydrogen source quinones preferred for use in the practice of my invention are set forth below in Table III.

Table III

| Exemplary Internal Hydrogen Source Quinones | |
|---|---|
| PR-1 | 5,8-dihydro-1,4-naphthoquinone |
| PR-2 | 5,8-dihydro-2,5,8-trimethyl-1,4-naphthoquinone |
| PR-3 | 2,5-bis(dimethylamino)-1,4-benzoquinone |
| PR-4 | 2,5-dimethyl-3,6-bis(dimethylamino)-1,4-benzoquinone |
| PR-5 | 2,5-dimethyl-3,6-bispyrrolidino-1,4-benzoquinone |
| PR-6 | 2-ethoxy-5-methyl-1,4-benzoquinone |
| PR-7 | 2,6-dimethoxy-1,4-benzoquinone |
| PR-8 | 2,5-dimethoxy-1,4-benzoquinone |
| PR-9 | 2,6-diethoxy-1,4-benzoquinone |
| PR-10 | 2,5-diethoxy-1,4-benzoquinone |
| PR-11 | 2,5-bis(2-methoxyethoxy)-1,4-benzoquinone |
| PR-12 | 2,5-bis(β-phenoxyethoxy)-1,4-benzoquinone |
| PR-13 | 2,5-diphenethoxy-1,4-benzoquinone |
| PR-14 | 2,5-di-n-propoxy-1,4-benzoquinone |
| PR-15 | 2,5-di-isopropoxy-1,4-benzoquinone |
| PR-16 | 2,5-di-n-butoxy-1,4-benzoquinone |
| PR-17 | 2,5-di-sec-butoxy-1,4-benzoquinone |
| PR-18 | 1,1'-bis(5-methyl-1,4-benzoquinone-2-yl)-diethyl ether |
| PR-19 | 2-methyl-5-morpholinomethyl-1,4-benzoquinone |
| PR-20 | 2,3,5-trimethyl-6-morpholinomethyl-1,4-benzoquinone |
| PR-21 | 2,5-bis(morpholinomethyl)-1,4-benzoquinone |
| PR-22 | 2-hydroxymethyl-3,5,6-trimethyl-1,4-benzoquinone |
| PR-23 | 2-(1-hydroxyethyl)-5-methyl-1,4-benzoquinone |
| PR-24 | 2-(1-hydroxy-n-propyl)-5-methyl-1,4-benzoquinone |
| PR-25 | 2-(1-hydroxy-2-methyl-n-propyl)-5-methyl-1,4-benzoquinone |
| PR-26 | 2-(1,1-dimethyl-2-hydroxyethyl)-5-methyl-1,4-benzoquinone |
| PR-27 | 2-(1-acetoxyethyl)-5-methyl-1,4-benzoquinone |
| PR-28 | 2-(1-methoxyethyl)-5-methyl-1,4-benzoqui none |
| PR-29 | 2-(2-hydroxyethyl)-3,5,6-trimethyl-1,4-benzoquinone |
| PR-30 | 2-ethoxy-5-phenyl-1,4-benzoquinone |
| PR-31 | 2-1-propoxy-5-phenyl-1,4-benzoquinone |
| PR-32 | 1,4-dihydro-1,4-dimethyl-9,10-anthraquinone |
| PR-33 | 2-dimethylamino-1,4-naphthoquinone |
| PR-34 | 2-methoxy-1,4-naphthoquinone |
| PR-35 | 2-benzyloxy-1,4-naphthoquinone |
| PR-36 | 2-methoxy-3-chloro-1,4-naphthoquinone |
| PR-37 | 2,3-dimethoxy-1,4-naphthoquinone |
| PR-38 | 2,3-diethoxy-1,4-naphthoquinone |
| PR-39 | 2-ethoxy-1,4-naphthoquinone |
| PR-40 | 2-phenethoxy-1,4-naphthoquinone |
| PR-41 | 2-(2-methoxyethoxy)-1,4-naphthoquinone |
| PR-42 | 2-(2-ethoxyethoxy)-1,4-naphthoquinone |
| PR-43 | 2-(2-phenoxy)ethoxy-1,4-naphthoquinone |
| PR-44 | 2-ethoxy-5-methoxy-1,4-naphthoquinone |
| PR-45 | 2-ethoxy-6-methoxy-1,4-naphthoquinone |
| PR-46 | 2-ethoxy-7-methoxy-1,4-naphthoquinone |
| PR-47 | 2-n-propoxy-1,4-naphthoquinone |
| PR-48 | 2-(3-hydroxypropoxy)-1,4-naphthoquinone |
| PR-49 | 2-isopropoxy-1,4-naphthoquinone |
| PR-50 | 7-methoxy-2-isopropoxy-1,4-naphthoquinone |
| PR-51 | 2-n-butoxy-1,4-naphthoquinone |
| PR-52 | 2-sec-butoxy-1,4-naphthoquinone |
| PR-53 | 2-n-pentoxy-1,4-naphthoquinone |
| PR-54 | 2-n-hexoxy-1,4-naphthoquinone |
| PR-55 | 2-n-heptoxy-1,4-naphthoquinone |
| PR-56 | 2-acetoxymethyl-3-methyl-1,4-naphthoquinone |
| PR-57 | 2-methoxymethyl-3-methyl-1,4-naphthoquinone |
| PR-58 | 2-(β-acetoxyethyl)-1,4-naphthoquinone |
| PR-59 | 2-N,N-bis(cyanomethyl)aminomethyl-3-methyl-1,4-naphthoquinone |
| PR-60 | 2-methyl-3-morpholinomethyl-1,4-naphthoquinone |
| PR-61 | 2-hydroxymethyl-1,4-naphthoquinone |
| PR-62 | 2-hydroxymethyl-3-methyl-1,4-naphthoquinone |
| PR-63 | 2-(1-hydroxyethyl)-1,4-naphthoquinone |
| PR-64 | 2-(2-hydroxyethyl)-1,4-naphthoquinone |
| PR-65 | 2-(1,1-dimethyl-2-hydroxyethyl)-1,4-naphthoquinone |
| PR-66 | 2-bromo-3-isopropoxy-1,4-naphthoquinone |
| PR-67 | 2-ethoxy-3-methyl-1,4-naphthoquinone |
| PR-68 | 2-chloro-3-piperidino-1,4-napthoquinone |
| PR-69 | 2-morpholino-1,4-naphthoquinone |
| PR-70 | 2,3-dipiperidino-1,4-naphthoquinone |
| PR-71 | 2-dibenzylamino-3-chloro-1,4-naphthoquinone |
| PR-72 | 2-methyloxycarbonylmethoxy-1,4-naphthoquinone |
| PR-73 | 2-(N-ethyl-N-benzylamino)-3-chloro-1,4-naphthoquinone |
| PR-74 | 2-morpholino-3-chloro-1,4-naphthoquinone |
| PR-75 | 2-pyrrolidino-3-chloro-1,4-naphthoquinone |
| PR-76 | 2-diethylamino-3-chloro-1,4-naphthoquinone |
| PR-77 | 2-diethylamino-1,4-naphthoquinone |
| PR-78 | 2-piperidino-1,4-naphthoquinone |
| PR-79 | 2-pyrrolidino-1,4-naphthoquinone |
| PR-80 | 2-(2-hexyloxy)-1,4-naphthoquinone |
| PR-81 | 2-neo-pentyloxy-1,4-naphthoquinone |
| PR-82 | 2-(2-n-pentyloxy)-1,4-naphthoquinone |
| PR-83 | 2-(3-methyl-n-butoxy)-1,4-naphthoquinone |
| PR-84 | 2-(6-hydroxy-n-hexoxy)-1,4-naphthoquinone |
| PR-85 | 2-ethoxy-3-chloro-1,4-naphthoquinone |
| PR-86 | 2-di(phenyl)methoxy-1,4-naphthoquinone |
| PR-87 | 2-(2-hydroxyethoxy)-3-chloro-1,4-naphthoquinone |
| PR-88 | 2-methyl-3-(1-hydroxymethyl)ethyl-1,4-naphthoquinone |
| PR-89 | 2-azetidino-3-chloro-1,4-naphthoquinone |
| PR-90 | 2-(2-hydroxyethyl-3-bromo-1,4-naphthoquinone |
| PR-91 | 2,3-dimorpholino-1,4-naphthoquinone |
| PR-92 | 2-ethylamino-3-piperidino-1,4-naphthoquinone |
| PR-93 | 2-ethoxymethyl-1,4-naphthoquinone |
| PR-94 | 2-phenoxymethyl-1,4-naphthoquinone |

Internal hydrogen source quinones and the aziridines are exemplary of photoreductants capable of relying entirely on the atoms initially present within the molecule to permit conversion to the corresponding reducing agent. In other photoreductants, conversion to the corresponding reducing agent may require that an adjuvant be present in intimate association with the photoreductant to donate the necessary atoms to permit formation of the reducing agent. Generally improved results can be obtained where an adjuvant, such as a compound providing an external source of labile hydrogen atoms, is employed in combination with the photoreductant, even though the photoreductant itself contains labile hydrogen atoms. Any conventional compatible source of labile hydrogen atoms can be employed in combination wth the photoreductants as an adjuvant. Generally preferred external hydrogen source compounds are organic compounds having a hydrogen atom attached to a carbon atom to which a substituent is also attached which greatly weakens the carbon-to-hydrogen bond, thereby rendering the hydrogen atom labile. Preferred hydrogen source compounds are those which have a hydrogen atom bonded to a carbon atom to which is also bonded the oxygen atom of an oxy substitutent and/or the trivalent nitrogen atom of an amine substitutent, including an amide or imine substitutent. Where the labile hydrogen source compound is of high molecular weight, it can also function as a binder. Specific examplary labile hydrogen source compounds include (poly(ethylene glycol), phenyl-1,2-ethanediol, poly(vinyl butyral), poly(vinyl acetal), methyl cellulose, ethyl cellulose, carboxymethyl cellulose, cellulose acetate butyrate, 4-nitrobenzyl alcohol, N-(hydroxymethyl)phthalimide, poly(vinyl alcohol), etc.

Specific examples of useful photroreductants and adjuvants are disclosed in 126 RD 12617 and 135 RD 13505, both cited above, as well as in U.S. Pat. No. 3,880,659 issued Apr. 29, 1975; 3,881,930 issued May 6, 1975; U.S. Pat. 3,887,372 issued June 3, 1975; U.S. Pat. No. 3,887,374 issued June 3, 1975 and U.S. Pat. No. 3,894,874 issued July 15, 1975, the disclosures of which are here incorporated by reference.

Again excluding for discussion below the complexing agent and the manganese complex, any conventional photographic element containing at least one radiation-sensitive silver halide layer can be employed in the practice of my invention. One or more conventional silver halide emulsion layers can be employed in forming the photographic elements 300, 400 and 500 and variations thereof having multiple radiation-sensitive layers, such as elements capable of forming multicolor dye images. Exemplary specific silver halide emulsions which are both positive-working and negativeworking are disclosed in 92 PLI 9232, cited above, paragraph I. These emulsions can be prepared, coated and/or modified according to conventional teachings as disclosed in paragraphs II through IV, VI through VIII, XII, XIV through XVIII and XXI of 92 PLI 9232, cited above, and here specifically incorporated by reference. As will be readily apparent to those skilled in the art, silver halide layers can contain photographic vehicles, such as hydrophilic colloids, e.g., gelatin, the siliver halide grains can be chemically sensitized, desensitized and/or spectrally sensitized. Stabilizers and antifoggants can be present in the silver halide layers. Hardeners for the vehicles can also be present in the layers. I specifically contemplate employing in the practice of my invention silver halide photographic elements of the types known to be useful in redox amplification dye-forming processes. I specifically contemplate the use of such photographic elements containing low concentrations of silver halide, e.g., below 30 mg. silver per 0.093 square meter, such as those disclosed to Travis, U.S. Pat. No. 3,765,891, issued Oct. 16, 1973 and by Bissonette U.S. Pat. Nos. 602,156 and 609,880, cited above, here incorporated by reference.

For the purpose of my invention, I incorporate into the radiation-sensitive layers of the photographic elements either a complexing agent which is capable of complexing with manganese and cobalt ions or a manganese complex formed with such a complexing agent. Where a manganese complexing agent is initially present in the photographic element, it can be incorporated as a preformed complex or can be formed in situ by first introducing the complexing agent and then introducing manganese ions.

It is known that both cobalt and manganese are capable of forming metal coordination compounds or complexes with a variety of ligand-forming compounds or complexing agents. Cobalt can provide four or six coordination sites in its divalent form, while manganese in its divalent form provides six coordination sites. Because of the much higher affinity of the cobalt ions for ligands, cobalt ions will readily displace manganese ions from metal coordination complexes.

The complexing agents which I employ are those which form stable, immobile complexes with cobalt and manganese ions and which are capable of forming up to four coordinate covalent bonds with manganses ions. Free manganses ions being highly catalystic for peroxide redox amplification reactions, the catalytic activity of the manganese complexes tends to increase with decreasing numbers of coordination sites provided by a single complexing compound. On the other hand, multidentate-forming ligands tend to immobilize the complex more effectively than monodentate ligands. The manganese and cobalt complexes then formed in the practice of my invention are typically mixtures of ligand-forming compounds coordinated with the metal ions to yield the desired immobility of the complexes while preseving the desired catalytic activity of the manganese ions. Complexing agents capable of forming bidenate and tridentate ligands with cobalt and manganese are specifically contemplated and preferred, employed alone or in combination with monodentate ligand-forming compounds. To insure stability and immobility, I generally prefer that the number of multidentate ligand-forming compounds incorporated in a metal complex at least equal the number of monodentate ligand-forming compounds present.

Where the photographic element is prepared with the manganese complex preformed therein, stability and/or mobility of the individual ligand-forming compounds included in the manganese are of no significance as long as the complex as a whole remains catalytic and immobile. Accordingly, in this instance it is possible to select individual ligands from among those known to form stable coordination bonds with cobalt atoms. For example, the preformed manganese complexes can include any of the ligands disclosed above as useful in the cobalt(III) complexes.

Where the complexing agent is initially incorporated in the photographic element alone - that is, not associated with manganese ions - it is chosen to be stable in the radiation-sensitive layer prior to exposure and processing and to be sufficiently insoluble in the manganese imbibition solution so that it is not leached from the element during this processing step. In a specific preferred form, the complexing agents employed in this embodiment of my invention are substantially water-insoluble, since this is the most common imbibition solvent. The initially present complexing agents are typically compounds capable of forming from two to four coordination bonds with cobalt or manganese. These complexing agents can, of course, be supplemented during the imbibition step during which the manganese complex is formed with other ligand-forming compounds initially present in the radiation-sensitive layer or, preferably, incorporated in the imbibition solution.

A number of multidentate ligand-forming compounds useful in forming immobile cobalt and manganese complexes are known and available for use in the practice of this invention. Exemplary of preferred such chelating compounds are ortho-salicylaldehydes, nitroso-arols, dithiooxamides, formazans, aromatic azo compounds, hydrazones, Schiff bases, etc. All of these classes of compounds, with the exception of ortho-salicylaldehydes, are disclosed in 135 RD 13505, cited above and here specifically incorporated by reference, as being useful complexing agents for cobalt(II). While some of these multidentate complexing agents contain chromophoric groups and will provide a visible coloration to the photographic element, this feature can be used in many instances to enhance image discrimination. For example, a more striking contrast between the image dye and the background areas may be produced or the coloration of the manganese complex may actually supplement the image discrimination provided by the image dye. Where low density and/or substantially neutral backgrounds are desired, the concentration of the complexing agent can be regulated to minimize visible coloration. Where a light background is desired, I prefer to employ complexing agents which form with cobalt(II) yellow or, preferably, substantially colorless complexes. For these applications I prefer the use of ortho-salicylaldehyde complexing agents, since they are substantially colorless when complexed with manganese or cobalt. Other immobile multidentate complexing agents of the type disclosed above for incorporation in cobalt(III) complexes can also be used to produce immobile cobalt and manganese complexes. While immobile complexing agents are preferred for the manganese imbibition forms of invention, they can, of course, be employed in practicing the manganese displacement forms of my process as well.

Preferred nitroso-arol chelating compounds are those in which the nitroso and hydroxy substituents are adjacent ring-position substituents (e.g., 2-nitrosophenols, 1-nitroso-2-naphthols, 2-nitroso-1-naphthols, etc.). Preferred nitroso-arols are those defined by the general formula:

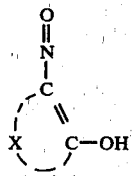

wherein X is comprised of the atoms necessary to complete an aromatic nucleus, typically a phenyl or naphthyl nucleus.

Dithiooxamide is a preferred chelating compound, as well as derivatives thereof having one or both nitrogen atoms substituted with an alkyl, alkaryl, aryl or aralkyl group. Preferred dithiooxamides are those capable of forming tridentate chelates, such as those defined by the formula:

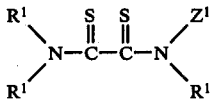

wherein $Z^1$ is a chelate ligand-forming group and $R^1$ is in each instance independently chosen from among groups such as $Z^1$, hydrogen, alkyl, alkaryl, aryl and aralkyl groups.

Preferred aromatic azo compounds are those capable of forming at least tridentate ligands with cobalt(III). These aromatic azo compounds are defined by the formula:

$$Z^2—N=N—Z^3$$

wherein $Z^2$ and $Z^3$ are independently chosen aromatic groups, both of which are capable of forming chelate ligands.

Preferred hydrazones capable of forming at least tridentate chelates with cobalt(III) are those of the general formula:

$$Z^4—CH=N—NH—Z^5$$

wherein $Z^4$ and $Z^5$ are independently chosen aromatic groups, both of which are capable of forming chelate ligands.

Preferred Schiff bases capable of forming at least tridentate chelates with cobalt(III) are those of the general formula:

$$Z^6—CH=N—Z^7$$

wherein $Z^6$ and $Z^7$ are independently chosen aromatic groups, both of which are capable of forming chelate ligands.

The aromatic ligand-forming substituents can take the form of either homocyclic or heterocyclic single- or multiple-ring substituents, such as phenyl, naphthyl, anthryl, pyridyl, quinolinyl, thiazolyl, benzothiazolyl, oxazolyl, benzoxazolyl, etc. In one form the aromatic substituent can exhibit a ligand-forming capability as a result of being substituted in the ring position adjacent the bonding position with a substituent which is susceptible to forming a ligand, such as an hydroxy, carboxy or amino group. In another form the aromatic substituent can be chosen to be an N-heterocyclic aromatic substituent which contains a ring nitrogen atom adjacent the azo bonding position - e.g., a 2-pyridyl, 2-quinolinyl, 2-thiazolyl, 2-benzothiazolyl, 2-oxazolyl, 2-benzoxazolyl or similar substituent. The aromatic substituents can, of course, bear substituents which do not interfere with chelating, such as lower alkyl (i.e., 1 to 6 carbon atoms), benzyl, styryl, phenyl, biphenyl, naphthyl, alkoxy (e.g., methoxy, ethoxy, etc.), aryloxy (e.g., phenoxy), carboalkoxy (e.g., carbomethoxy, carboethoxy, etc.). carboaryloxy (e.g., carbophenoxy, carbonaphthoxy), acyloxy (e.g., acetoxy, benzoxy, etc.), acyl (e.g., acetyl, benzoyl, etc.), halogen (i.e., fluoride, chloride, bromide, iodide), cyano, azido, nitro, haloalkyl (e.g., trifluoromethyl, trifluoroethyl, etc.), amino (e.g., dimethylamino), amido (e.g., acetamido, benzamido), ammonium (e.g., trimethylammonium), azo (e.g., phenylazo), sulfonyl (e.g., methylsulfonyl, phenylsulfonyl), sulfoxy (e.g., methylsulfoxy), sulfonium (e.g., dimethyl sulfonium), silyl (e.g., trimethylsilyl) and thioether (e.g., methylthio) substituents. It is generally preferred that the alkyl substituents and substituent moieties of the chelating compounds each have 20 or fewer carbon atoms, most preferably 6 or fewer carbon atoms. The aryl substituents and substituent moieties of the chelating compounds are each preferably phenyl or naphthyl groups. Exemplary preferred multidentate chelate-forming immobile complexing agents are set forth in Table IV.

TABLE IV

| Exemplary Immobile Complexing Agents | |
|---|---|
| CH-1 | 1-(2-pyridyl)-3-phenyl-5-(2,6-dimethylphenyl)formazan |
| CH-2 | 1-(2-pyridyl)-3-n-hexyl-5-phenyl-2H-formazan |
| CH-3 | 1-(2-pyridyl)-3,5-diphenylformazan |
| CH-4 | 1-(benzothiazol-2-yl)-3,5-diphenyl-2H-formazan |
| CH-5 | 1-(2-pyridyl)-3-phenyl-5-(4-chlorophenyl)formazan |
| CH-6 | 1,1'-di(thiazol-2-yl)-3,3'-diphenylene-5,5'-diphenylformazan |
| CH-7 | 1,3-dodecyl-5-di(benzothiazol-2-yl)formazan |
| CH-8 | 1-phenyl-3-(3-chlorophenyl)-5-(benzothiazol-2-yl)formazan |
| CH-9 | 1,3-cyano-5-di(benzothiazol-2-yl)formazan |
| CH-10 | 1-phenyl-3-propyl-5-(benzothiazol-2-yl)formazan |
| CH-11 | 1,3-diphenyl-5-(4,5-dimethylthiazol-2-yl)formazan |
| CH-12 | 1-(2-pyridyl)-3,5-diphenylformazan |
| CH-13 | 1-(2-quinolinyl)-3-(3-nitrophenyl)-5-phenylformazan |
| CH-14 | 1-(2-pyridyl)-3-(4-cyanophenyl)-5-(2-tolyl)formazan |
| CH-15 | 1,3-naphthalene-bis{3-[2-(2-pyridyl)-5-(3,4-dichlorophenyl)formazan]} |
| CH-16 | 1-(2-pyridyl)-5-(4-nitrophenyl)-3-phenylformazan |
| CH-17 | 1-(benzothiazol-2-yl)-3,5-di(4-chlorophenyl)formazan |
| CH-18 | 1-(benzothiazol-2-yl)-3-(4-iodophenyl)-5-(3-nitrophenyl)formazan |
| CH-19 | 1-(benzothiazol-2-yl)-3-(4-cyanophenyl)-5-(2-fluorophenyl)formazan |
| CH-20 | 1-(4,5-dimethylthiazol-2-yl)-3-(bromophenyl)-5-(3-trifluorophenyl)formazan |
| CH-21 | 1-(benzoxazol-2-yl)-3,5-diphenylformazan |
| CH-22 | 1-(benzoxazol-2-yl)-3-phenyl-5-(4-chlorophenyl)formazan |
| CH-23 | 1,3-diphenyl-5-(2-pyridyl)formazan |
| CH-24 | 1-(2,5-dimethylphenyl)-3-phenyl-5-(2-pyridyl)formazan |
| CH-25 | 1-(2-pyridyl)-3-(4-cyanophenyl)-5-(2-tolyl)formazan |
| CH-26 | 1-(2-benzothiazolyl)-3-phenyl-5-(8-quinolyl)formazan |
| CH-27 | 1-(4,5-dimethylthiazol-3-yl)-3-(4-bromophenyl)-5-(3-trifluoromethylphenyl)formazan |
| CH-28 | 1,3-diphenyl-5-(benzothiazol-2-yl)formazan |
| CH-29 | 1-(benzoxazol-2-yl)-3-phenyl-5-(4-chlorophenyl)formazan |
| CH-30 | 1,3-diphenyl-5-(2-quinolinyl)formazan |
| CH-31 | 1-phenylazo-2-phenol |
| CH-32 | 1-phenylazo-4-dimethylamino-2-phenol |
| CH-33 | 2-hydrophenylazo-2-phenol |
| CH-34 | 1-(2-hydroxyphenylazo)-2-naphthol |
| CH-35 | 1-(2-pyridylazo)-2-naphthol |
| CH-36 | 1-(2-pyridylazo)-2-phenol |
| CH-37 | 1-(2-pyridylazo)-4-resorcinol |
| CH-38 | 1-(2-quinolylazo)-2-naphthol |
| CH-39 | 1-(2-thiazolylazo)-2-naphthol |
| CH-40 | 1-(2-benzothiazolylazo)-2-naphthol |
| CH-41 | 1-(4-nitro-2-thiazolylazo)-2-naphthol |
| CH-42 | 1-(2-thiazolylazo)-4-resorcinol |
| CH-43 | 2,2-azodiphenol |
| CH-44 | 1-(3,4-dinitro-2-hydroxyphenylazo)-2,5-phenylenediamine |
| CH-45 | 1-(2-benzothiazolylazo-2-naphthol |
| CH-46 | 1-(1-isoquinolylazo)-2-naphthol |
| CH-47 | 2-pyridinecarboxaldehyde-2-pyridylhydrazone |
| CH-48 | 2-pyridinecarboxaldehyde-2-benzothiazolylhydrazone |
| CH-49 | 2-thiazolecarboxaldehyde-2-benzoxazolylhydrazone |
| CH-50 | 2-pyridinecarboxaldehyde-2-quinolylhydrazone |
| CH-51 | 1-(2-pyridinecarboxaldehydeimino)-2-naphthol |

TABLE IV-continued

| Exemplary Immobile Complexing Agents | |
|---|---|
| CH-52 | 1-(2-quinolinecarboxaldehydeimino)-2-naphthol |
| CH-53 | 1-(2-thiazolecarboxaldehydeimino)-2-naphthol |
| CH-54 | 1-(2-benzoxazolecarboxaldehydeimino)-2-phenol |
| CH-55 | 1-(2-pyridinecarboxaldehydeimino)-2-phenol |
| CH-56 | 1-(2-pyridinecarboxaldehydeimino)-2-pyridine |
| CH-57 | 1-(2-pyridinecarboxaldehydeimino)-2-quinoline |
| CH-58 | 1-(4-nitro-2-pyridinecarboxaldehydeimino)-2-thiazole |
| CH-59 | 1-(2-benzoxazolecarboxaldehydeimino)-2-oxazole |
| CH-60 | 1-nitroso-2-naphthol |
| CH-61 | 2-nitroso-1-naphthol |
| CH-62 | 1-nitroso-3,6-disulfo-2-naphthol |
| CH-63 | disodium 1-nitroso-2-naphthol-3,6-disulfonate |
| CH-64 | 4-nitrosoresorcinol |
| CH-65 | 2-nitroso-4-methoxyphenol |
| CH-66 | N-(2-pyridyl)dithiooxamide |
| CH-67 | N,N'-di(2-pyridyl)dithiooxamide |
| CH-68 | N-(2-benzothiazolyl)dithiooxamide |
| CH-69 | N-(2-quinolinyl)dithiooxamide |
| CH-70 | N,N-dimethyldithiooxamide |
| CH-71 | dithiooxamide |

While not essential to the practice of my process, where a color-developing agent is employed as a dye-image-generating reducing agent, I prefer to practice my process using photographic elements containing at least one incorporated color coupler. The color couplers employed in combination with the color-developing agents include any compound which reacts (or couples) with the oxidation products of a primary aromatic amino developing agent on photographic development to form an image dye and also any compound which provides useful image dye when reacted with oxidized primary aromatic amino developing agent such as by a coupler-release mechanism. These compounds have been variously termed "color couplers", "photographic color couplers", "dye-release couplers", "dye-image-generating couplers", etc., by those skilled in the photographic arts. The photographic color couplers can be incorporated in the processing solutions where amplification occurs, described below, or in the photographic element, e.g., as described and referred to in 92 PLI 9232, cited above, paragraph XXII. When they are incorporated in the element, they preferably are nondiffusible in a hydrophilic colloid binder (e.g., gelatin) useful for photographic silver halide. The couplers can form diffusible or nondiffusible dyes. Typical preferred color couplers include phenolic, 5-pyrazolone and open-chain ketomethylene couplers. Specific cyan, magenta and yellow color couplers which can be employed in the practice of this invention are described by Graham et al in U.S. Pat. No. 3,046,129 issued Jan. 24, 1962, column 15, line 45, through column 18, line 51, which disclosure is incorporated herein by reference. Such color couplers can be dispersed in any convenient manner, such as by using the solvents and the techniques described in U.S. Pat. No. 2,322,027, by Jelley et al issued June 15, 1943, or U.S. Pat. No. 2,801,171 by Fierke et al issued July 30, 1957. When coupler solvents are employed, the most useful weight ratios of color coupler to coupler solvent range from about 1:3 to 1:0.1. The useful couplers include Fischer-type incorporated couplers such as those described by Fischer in U.S. Pat. No. 1,055,155 issued Mar. 4, 1913, and particularly nondiffusible Fischer-type couplers containing branched carbon chains, e.g., those referred to by Willems et al in U.S. Pat. No. 2,186,849. Particularly useful in the practice of this invention are the nondiffusible color couplers which form nondiffusible dyes.

In certain preferred embodiments, the couplers incorporated in the photographic elements to be processed are water-insoluble color couplers which are incorporated in a coupler solvent which is preferably a moderately polar solvent. Typical useful solvents include tri-o-cresyl phosphate, di-n-butyl phthalate, diethyl lauramide, 2,4-ditert-amylphenol, liquid dye stabilizers as described in an article entitled "Improved Photographic Dye Image Stabilizer-Solvent", *Product Licensing Index,* Vol. 82, pp. 26–29, March, 1971, and the like.

In certain highly preferred embodiments, the couplers are incorporated in the photographic elements by dispersing them in a water-miscible, low-boiling solvent having a boiling point of less than 175° C. and preferably less than 125° C., such as, for example, the esters formed by aliphatic alcohols and acetic or propionic acids, i.e., ethyl acetate, etc. Typical methods for incorporating the couplers in photographic elements by this technique and the appropriate solvents are disclosed in U.S. Pat. No. 2,949,360, column 2, by Julien; U.S. Pat. No. 2,801,170 by Vittem et al; and U.S. Pat. No. 2,801,171 by Fierke et al.

Color couplers can also be incorporated into the photographic elements that are useful in the practice of my invention by blending them into the photographic emulsions in the form of latexes, called "coupler-loaded" latexes. Coupler-loaded latexes are polymeric latexes into the particles of which has been blended the coupler(s). Coupler-loaded latexes can be prepared in accordance with the process of Chen, which is described in U.S. Ser. No. 575,689 filed May 8, 1975, now abandoned in favor of pending continuation-in-part patent application Ser. No. 778,182, filed Mar. 16, 1977, or of Chen and Mendel as described in U.S. Ser. No. 575,570 filed May 8, 1975 now abandoned. Each of these disclosures is incorporated by reference into the present application. Briefly, these processes involve (1) the dissolution of the coupler into a hydrophilic organic solvent, (2) blending into the resulting solution a selected latex, and (3) optionally removing the organic solvent, for example, by evaporation thereof.

The proportions of the ingredients in the photographic element radiation-sensitive layers employed in the practice of my process can be widely varied without departing from the spirit of the invention. I generally prefer that at least $1 \times 10^{-7}$ moles of immobile complexing agent or the manganese ions complexed therewith be present in the radiation-sensitive layer per 0.093 square meter (square foot). Preferred concentrations are from $1 \times 10^{-6}$ to $1 \times 10^{-5}$ mole/0.093 m.$^2$. Generally, it is unnecessary to employ concentrations above $1 \times 10^{-4}$ mole/0.093 m.$^2$.

The remaining ingredients of the radiation-sensitive layers can be present in conventional concentrations. Where a cobalt(III) complex is incorporated in the radiation-sensitive layer for purposes of imaging, the cobalt(III) complex can be present in the same general concentration levels noted above for the complexed manganese and initially present immobile complexing agent. It is generally preferred to incorporate from 0.1 to 10 moles of photoreductant per mole of cobalt(III) complex. The spectral sensitizers are preferably incorporated in concentrations of from 0.01 to 100 moles per mole of cobalt(III) complex. Adjuvants for the photoreductants are preferably employed in concentrations of from 0.5 to 10 moles per mole of photoreductant. While roughly stoichiometric quantities of reactants are desired for maximum efficiency, excess quantities of reactants are, of course, possible. Although not essential, binders can account for up to 99 percent by weight of the radiation-sensitive layer, but are typically employed in proportions of from 50 to 90 percent by weight of the radiation-sensitive layer. Where a silver halide radiation-sensitive imaging layer is provided, conventional concentrations of ingredients are contemplated, although redox amplification imaging allows lower silver halide contents to be employed, down to about 300 mg./m.$^2$, than are otherwise typical. Where color couplers are incorporated, they can be present in concentrations of from 1 to 15 parts per part by weight of cobalt(III) complex or silver halide. Advantageously, the coupler is present in an amount sufficient to give a maximum dye density in the fully processed element of at least 1.7, preferably at least 2.0 and, in the case of transparent support elements, preferably at least 3.0. For most applications, radiation-sensitive layer coating thicknesses of from 2 microns to 20 microns are preferred.

While I have described simple photographic elements having single radiation-sensitive layers in which the various reactants are incorporated, it is appreciated that the photographic elements can be varied in structure without departing from my invention. For example, instead of incorporating in the photographic element a single radiation-sensitive layer, a plurality of radiation-sensitive layers can be included. In one specific preferred form, at least three radiation-sensitive layers are incorporated, each responding to a differing (blue, green or red) third of the visible spectrum for the purpose of forming multicolor images. Conventional subbing layers, interlayers and overlayers can be incorporated in the photographic elements. Also, it is contemplated to incorporate reactants in adjacent layers rather than entirely in the radiation-sensitive layers themselves. Additional reactants which can be incorporated in the photographic element or the process solutions are discussed below. Still other variations of the photographic elements will readily occur to those skilled in the art having knowledge of my teachings.

EXPOSURE CONDITIONS AND PROCESSING SOLUTIONS

A source of actinic radiation can be employed for imagewise exposure to which the radiation-sensitive layers are known to respond. The silver halide, either by reason of native sensitivity or sensitization, can respond to ultraviolet, visible, infrared, gamma, X-ray, electron beam or neutron radiation. Within the visible spectrum the silver halide may be responsive to only the blue portion of the spectrum or can be orthochromatically or panchromatically sensitized. The cobalt(III) complexes used for imaging in the radiation-sensitive layer are responsive to ultraviolet radiation and can be rendered responsive to radiation within the visible spectrum, as desired, through proper choice of sensitizing dyes and/or photoreductants.

Where the photographic element initially contains a complexing agent and the manganese ions to be coordinated are introduced by imbibition, an imbibition solution can be employed to introduce the manganese ions into the photographic element. The imbibition solution can be comprised of a polar solvent, such as water, and can contain dissolved therein one or more soluble manganese salts. Any conventional soluble salt of manganese can be employed which incorporates an anion compatible with the other ingredients of the photographic element. Exemplary preferred manganese salts include manganese acetate, manganese bromide, manganese chlorine, manganese fluorosilicate, manganese iodide, manganese nitrate, manganese sulfate, etc. and similar manganese salts. By proper choice of imbibition times, complexing agents and other parameters, the concentrations of the manganese salts in the imbibition solutions can be widely varied. I generally prefer that the imbibition solutions contain a manganese ion concentration of from about $1 \times 10^{-5}$ to $1 \times 10^{-2}$ mole per liter. While I prefer to employ approximately neutral pH manganese imbibition solutions, the solution can range from 5 to 9 in pH without adverse results.

Where the photographic element to be processed contains a silver halide radiation-sensitive layer, it can be processed following exposure using conventional developer solutions and development techniques. Where the photographic element contains an incorporated color coupler, only black-and-white developing agents - that is, developing agents which upon oxidation either do not couple or do not form visible dyes upon coupling -should be present in the developer composition. For example, where a color coupler is present in the photographic element, any developing agent employed in the black-and-white development step of silver halide color reversal processing is useful. Where the photographic element does not contain an incorporated color coupler, developer compositions containing color-developing agents can also be employed.

Although not necessary to the practice of my process, following development a conventional stop bath, typically dilute acetic acid, can be employed, together with water-rinsing of the photographic element. Specific illustrative photographic developers and instructions for their use are disclosed in *Handbook of Chemistry and Physics,* 36th Edition, under the title "Photographic Formulae", at page 3001, et seq., and in Processing Chemicals and Formulas, 6th Edition, published by Eastman Kodak Company (1963), the disclosures of which are here incorporated by reference.

The photographic elements containing a developed silver image can be processed to form a corresponding cobalt complex image by being placed into a conventional alkaline bleaching solution containing a cobalt(III) complex and a compound which is capable of forming a salt with silver but which is incapable of directly oxidizing image silver. Aqueous alkaline bleach solutions of this general type have been disclosed, for example, in British Pat. No. 777,635, U.S. Pat. No. 3,615,508 by Stephen and U.S. Ser. No. 602,156 by Bissonette, all cited above and here incorporated by reference.

The cobalt(III) complexes employed in bleaching are chosen from among those which permanently release ligands upon reduction. As is well-understood in the art, cobalt(III) complexes release ligands upon reduction. The cobalt(III) complexes which I employ are those which upon reoxidation of cobalt following reduction of the cobalt(III) complex are not regenerated. Where monodentate or bidentate ligands are initially present in a cobalt(III) complex, these ligands are generally so mobile that, once released, they migrate away from the cobalt(II) and cannot be recaptured when the cobalt is reoxidized to cobalt(III). I accordingly prefer to employ cobalt(III) complexes in which each of the ligands present is a monodentate and/or bidentate ligand. Such complexes are disclosed, for example, in U.S. Ser. No. 402,432, cited above, and in U.S. Pat. No. 3,834,907 by Bissonette issued Sept. 10, 1974, U.S. Pat. No. 3,862,842 issued Jan. 28, 1975, U.S. Pat. No. 3,856,524 issued Dec. 24, 1974, U.S. Pat. No. 3,826,652 issued July 30, 1974, U.S. Pat. No. 3,822,129 by Dunn issued July 2, 1974, U.S. Pat. No. 3,841,873 by Mowrey et al issued Oct. 15, 1974, and U.S. Pat. No. 3,765,891 by Travis issued Oct. 16, 1973. The disclosures of these patents are here incorporated by reference.

While the concentration of the cobalt(III) complex in the bleaching solution can correspond to that employed in conventional bleaching solutions of this type,, it must be appreciated that the purpose served by the cobalt(III) complex in this application is substantially different from that heretofore sought in the art. Whereas in conventional bleaching solutions it is desired to bleach the image silver, it is immaterial to the practice of my invention whether the image silver is bleached, since the desired products are the cobalt ions released by bleaching. In fact, in view of the amplification possible in the practice of my invention, the silver image may not be objectionable for viewing since the initial silver halide content can be quite low, as indicated above. The amount of cobalt(III) complex incorporated in the bleaching solution is then primarily chosen to provide sufficient cobalt ions on bleaching to displace manganese ions from the catalytic manganese complex present in the photographic element or to form an immobile cobalt complex with free complexing agent initially present in the photographic element. I generally contemplate using then from about $1 \times 10^{-5}$ to $1 \times 10^{-2}$ mole of cobalt(III) complex per liter of bleaching solution. I specifically contemplate placing all or a portion of the cobalt(III) complex used for bleaching in the photographic element where the radiation sensitive layers are silver halide layers. This is possible since the cobalt(III) complex is normally responsive to only ultraviolet radiation below 300 nm. while the silver halide can be exposed using visible light. Hence, there is no minimum required cobalt(III) complex concentration in the bleaching solution used for processing the silver halide photographic elements.

In addition to the cobalt(III) complex, in the bleaching solution a compound is incorporated which is capable of forming a silver salt but which is incapable of oxidizing image silver. Where the photographic element is chosen so that it contains unfixed silver halide at the time of bleaching, these silver salt-forming compounds can, in a preferred form of my process, be used in combination with the cobalt(III) complex simultaneously to bleach and fix the photographic element.

The silver salt-forming compounds employed in my bleaching step can, in one form, take the form of a conventional silver halide solvent. Silver halide solvents are defined as compounds which, when employed in an aqueous solution (60° C.), are capable of dissolving more than ten times the amount (by weight) of silver halide which can be dissolved in water at 60° C.

Typical useful silver halide solvents include water-soluble thiosulfates (e.g., sodium thiosulfate, potassium thiosulfate, ammonium thiosulfate, etc.), thiourea, ethylenethiourea, a water-soluble thiocyanate (e.g., sodium thiocyanate, potassium thiocyanate and ammonium thiocyanate), as well as water-soluble sulfur-containing dibasic acid and diol silver halide solvents, such as, for example, those disclosed in Bissonette U.S. Ser.

Nos. 602,156; 609,880 and 402,432 cited above and here incorporated by reference.

The silver halide solvent can be incorporated in the bleaching bath within conventional concentration limits, such as those disclosed, for example in copending patent application U.S. Ser. No. 402,432 and British Pat. No. 777,635, both cited above. Where the silver halide solvent is being incorporated into the bleaching bath and it is desired to bleach and fix an element containing a photographic silver halide emulsion layer, optimum concentrations of the silver halide solvent in the bleaching bath can vary significantly, depending upon such factors as the thickness and composition of the emulsion layer, the pH of the bleaching solution, the temperature of processing, agitation, etc. Generally, in a preferred form of my invention, from about 0.2 to 250 grams or to the saturation limit of solubility of an ammonium or alkali metal thiosulfate are used per liter of processing solution and, most preferably, about 0.5 to 150 grams of sodium thiosulfate are employed per liter of the bleaching bath.

Although the use of a silver halide solvent can be relied upon to bleach and/or fix efficiently a photographic element containing a photographic silver image in a silver halide emulsion layer, the use of a silver halide solvent is not required for the practice of my process. Silver image bleaching can be satisfactorily achieved alternatively by employing high levels of bromide or chloride ions in the bleaching solution. The same water-soluble bromide and chloride ion-providing compounds can be employed in the bleaching solution as are typically employed in developer solutions. For example, ammonium and alkali metal bromides and chlorides are fully satisfactory for use in the bleaching solutions of my process. Useful silver image bleaching can be achieved with these halide ions at concentrations above about 0.08 mole of halide ion per liter. Typically, where it is intended merely to bleach the photographic silver image and fixing of silver halide is not desired, concentrations of these halide ions above about 0.4 mole of halide ion per liter are unnecessary for achieving satisfactory results. However, very high concentrations of chloride and bromide ions are contemplated, particularly where concurrent fixing of silver halide is desired. The bromide and chloride ions can generally be incorporated up to the solubility limits of the salt being employed. Where these halide ions are employed in combinations with silver halide solvents, lesser quantities of halide ion can contribute usefully to bleaching and fixing of photographic elements processed according to my invention.

Instead of substituting halide ions wholly or partially for silver halide solvents in the bleaching solution, it is also possible to omit both silver halide solvents and halide ions from the bleaching solution entirely. That is, the bleaching solution need not contain a compound which forms a soluble salt with silver but which is incapable of bleaching image silver. In this form of my process, a silver halide solvent is incorporated in the photographic element being processed instead of the bleaching bath. For example, certain silver halide solvents, e.g., isothiuronium, thiuronium compounds, bis-isothiuronium compounds and 3-S-thiuronium salts, can be incorporated in photographic elements to be processed according to my invention. Solvents of this type are described in U.S. Pat. No. 3,506,444 issued Apr. 14, 1970, U.S. Pat. No. 3,669,670 issued June 13, 1972, and U.S. Pat. No. 3,301,678 issued Jan. 31, 1967. These silver halide solvents can, of course, be wholly or partially incorporated in the bleaching bath, if desired.

The end which I achieve through subjecting an element having a photographic silver image to a bleaching bath is substantially different from that heretofore sought in the art. Whereas the art has heretofore employed bleaching baths to remove the photographic silver image and, in most instances, to fix concurrently any radiation-sensitive silver halide present, bleaching and fixing are not the essential features of my process. While in many applications bleaching and fixing of a photographic element being processed according to my invention is a desirable and intended result, in many applications of my process the photographic silver image can be left at least partially unbleached and any residual radiation-sensitive silver halide can be left unfixed.

Quite surprisingly, I have recognized that bleaching is a means of obtaining an image pattern of an immobile cobalt complex, usually a cobalt(II) complex, formed as a reaction product corresponding to the photographic silver image (which usually in turn conforms to an original latent image pattern formed on imagewise exposure of the photographic element). Whereas the cobalt(II) reaction product formed in conventional photographic silver image bleaching has been viewed as a by-product of the process, I have observed quite unexpectedly that this reaction product can be generated and retained in an image pattern used to define a redox amplification reaction.

While the bleaching and fixing baths which I employ containing cobalt(III) complexes can be of conventional composition, I employ only those bleaching baths which have a pH of from about 5 to 9 and, most preferably, I employ bleaching and fixing baths having a substantially neutral pH, typically of from about 6 to 8. This is in direct contrast to the use of alkaline bleaching and fixing baths in copending, commonly assigned, patent aplication U.S. Ser. No. 602,156, cited above. Whereas in the previously filed patent application it is intended to immobilize cobalt(II) as it is formed so that it produces an immobile image, probably by complexing with water and/or gelatin, in my process I intend that the cobalt, freed by reduction of cobalt(III), complex selectively with the complexing agent provided for this purpose or displace manganese from its coordination complex. Accordingly, it is necessary that the free cobalt ions be capable of migrating in an aqueous environment to encounter the complexing agent or manganese complex. Generally optimum formation of the desired cobalt complexes, typically cobalt(II) complexes, can be achieved under neutral or slightly acid bleaching and/or fixing conditions.

Once the catalytic manganese image and the reversal cobalt complex image have been formed, I transfer the photographic element being processed to redox amplification bath containing a peroxide oxidizing agent. The amplification bath can take the form of conventional peroxide oxidizing agent containing redox amplification baths of the type disclosed in U.S. Pat. Nos 3,674,490 and 3,776,730, each cited above. The bath can also take the form of that disclosed in British Pat. No. 1,329,444 or "Image Amplification Systems", Item No. 11660 of *Research Disclosure, published December,* 1973. The disclosures of each of the above are herein incorporated by reference. These redox amplification baths are aqueous solutions containing a peroxide oxidizing agent.

The peroxide oxidizing agents employed in the practice of my invention can take any convenient conventional form. Generally water-soluble compounds containing a peroxy group are preferably employed as peroxide oxidizing agents in the practice of my invention. Inorganic peroxide compounds or salts of peracids, for example, perborates, percarbonates or persilicates, and particularly hydrogen peroxide, can be employed as peroxide oxidizing agents in the practice of my invention as well as organic peroxide compounds such as benzoyl peroxide, percarbamide and addition compounds of hydrogen peroxide and aliphatic acid amides, polyalcohols, amines, acyl-substituted hydrazines, etc. I prefer to employ hydrogen peroxide, since it is highly active and easily handled in the form of aqueous solutions. Peroxide oxidizing agent concentrations of from 0.001 mole to 0.5 mole per liter of amplification bath are preferred.

In addition to at least one peroxide oxidizing agent, the redox amplification bath additionally contains a dye-image-generating reducing agent. The dye-image-generating reducing agent can be of any conventional type heretofore employed in redox amplification baths. In one form, the dye-image-generating reducing agent is a compound which forms a highly colored reaction product upon oxidation or which upon oxidation is capable of reacting with another compound, such as a color coupler, to form a highly colored reaction product. Where the dye-image-generating reducing agent forms a colored reaction product directly upon oxidation, it can take the form of a dye precursor such as, for example, a leuco dye or vat dye that becomes highly colored upon oxidation.

Where the dye-image-generating reducing agent is oxidized to form a highly colored reaction product with another compound, such as a color coupler, the dye-image-generating reducing agent is preferably employed in the form of a color-developing agent. The coupler to be employed in combination with the color-developing agent can be present in the redox amplification bath in the same concentrations normally employed in color-developer compositions. In a preferred form, however, the coupler is incorporated in the photographic element to be processed.

Instead of producing a colored reaction product upon oxidation, the dye-image-generating reducing agent can be of a type which is initially colored, but which can be used to provide an imagewise distribution of image dye by alteration of its mobility upon oxidation. Image-dye-generating reducing agents of this type include dye developers of the type disclosed, for example, by Rogers in U.S. Pat. Nos. 2,774,668 issued Dec. 18, 1956, and 2,983,606 issued May 9, 1961, here incorporated by reference. These compounds are silver halide developing agents which incorporate a dye moiety. Upon oxidation by the peroxide oxidizing agent directly or acting through a crossoxidizing auxiliary silver halide developing agent (such as described above), the dye developer alters its mobility to allow a dye image to be produced. Typically, the dye developer goes from an initially mobile to an immobile form upon oxidation in the redox amplification bath.

The term "immobile" used herein as applied to metal coordination couplers, complexing agents, dye-image-generating reducing agents, couplers and their reaction products has the meaning commonly applied to the term in color photography and denotes materials which for all practical purposes do not migrate nor wander through photographic hydrophilic colloid layers, such as gelatin, during processing in aqueous alkaline solutions. The same meaning is attached to the term "non-diffusible". The terms "diffusible" and "mobile" have meanings converse to the above.

The amount of dye-image-generating reducing agent incorporated within the amplification bath can be varied over a wide range corresponding to the concentrations in conventional photographic developer baths. The amount of color-developing agent used in the amplification bath is preferably from about 1 to 20 and, most preferably, from about 2 to 10 grams per liter, although both higher and lower concentrations can be employed.

Since the dye-image-generating reducing agents employed in the practice of my process have heretofore been employed in the art in silver halide developer solutions, best results can be obtained by maintaining the amplification bath within the alkaline pH ranges heretofore employed in developing photographic silver halide emulsions to form dye images using these dye-image-generating reducing agents. Preferred alkalinity for the amplification bath is at least 8, most preferably from 10 to 13. The amplification bath is typically maintained alkaline using activators of the type described above in connection with the developing step of my process. Other addenda known to facilitate image-dye formation in alkaline photographic developer solutions with specific dye-image-generating reducing agents can also be included in the amplification bath. For example, where incorporated color couplers are employed, it may be desirable to incorporate an aromatic solvent such as benzyl alcohol to facilitate coupling.

Examples

The practice of my invention can be better appreciated by reference to the following examples. cl Example 1

The Nonsilver Imaging Manganese Displacement Approach

A. A photographic element was prepared having a film support and a nonsilver, radiation-sensitive, cobalt-(III) complex-containing layer coated thereon. The radiation-sensitive layer contained the ingredients set forth below in Table V. Unless otherwise stated, all coating densities in the examples are reported parenthetically in terms of mg./0.093 meter$^2$ (i.e., mg./ft.$^2$).

Table V

| Photographic Element 1-A |
|---|
| radiation-sensitive layer: gelatin (300); cyan-dye-forming coupler 2-[α-(2,4-di-tert-amylphenoxy)butyramido]-4,6-dichloro-5-methylphenol (50); coupler solvent di-n-butyl phthalate (75); cobalt hexammine trifluoroacetate (15); complexing agent nitrosoresorcinol, sodium salt (2); formaldehyde hardener (150); 2-(N-benzyl-N-ethylamino)-3-chloronaphthoquinone photoreductant (20) |
| transparent poly(ethylene terephthlate) film support |

The gelatin contained 3 parts per million of manganese which reacted with the complexing agent to form an immobile manganese complex.

B. A sample of the photographic element was exposed for 4 sec. with a 1000-watt quartz-iodide lamp at a distance of approximately 32 centimeters (1 foot) through a conventional step tablet. Following exposure, the sample was treated for 1 min. with ammonia fumes while being maintained at a temperature of about 50° C. (120° F.). The sample was then immersed for about 15 sec. in an amplifier bath having the composition set forth in Table VI.

Table VI

| Amplifier Bath 1-B | |
|---|---|
| $H_2O_2$(30% by wt. in water) | 6 g. |
| $K_2CO_3$ | 10 g. |
| $K_2SO_3$ | 2 g. |
| 4-amino-N-ethyl-N-(2-methoxyethyl)-m-toluidine, di-p-toluenesulfonate | 5 g. |
| water to 1 liter (pH 10.5) | |

Following amplification, the sample was immersed in a dilute acetic acid bath for the purpose of stopping dye formation, washed in water and dried. The sample contained a positive cyan dye image. The dye image exhibited a maximum density of 1.4, a minimum density of 0.3 and a contrast of 0.8.

C. Qualitatively similar positive dye images are obtainable using in place of or in combination with nitrosoresorcinol a nitrosonaphthol complexing agent.

D. Qualitatively similar results can be obtained by omitting the step of ammonia-fuming. As is discussed in the Adin et al and Do Minh copending patent applications referenced above, ammonia-fuming is useful with quinone photoreductants wherein the ring containing the carbonyl groups is substituted or fused to an adjacent ring (as in naphthoquinone) so that no hydrogen atom is bonded to a ring carbon atoms immediately adjacent a carbonyl group. Where a phenyl ring position adjacent the carbonyl group is unsubstituted, ammonia-fuming can produce fogging of the photographic element. Ammonia-fuming is advantageous then in accelerating reduction by substituted quinone photoreductants, but is not essential. While the internal hydrogen source quinones set forth in Table III vary in speed of photoresponse and response to ammonia-fuming, all of these photoreductants produce positive dye images when heated as in paragraph 1-B in the absence of ammonia, and in many instances response rates of acceptable speed are available without heating.

EXAMPLE 2

The Nonsilver Imaging Manganese Imbibition Approach

A. A photographic element having a film support and a nonsilver, radiation-sensitive, cobalt(III) complex-containing layer coated thereon was prepared. the radiation-sensitive layer contained the ingredients set forth below in Table VII.

Table VII

| Photographic Element 2-A |
|---|
| radiation-sensitive layer: gelatin (see 1-A) (250); cyan-dye-forming coupler (see 1-A) (50); loaded latex poly(n-butylacrylte: 2-acrylamido-2-methylpropane sulfonic acid: 2-acetoxyethyl-methacrylate (10:2:1 mole ratio) (100); cobalt hexammine trifluoroacetate (20); 5-bromo-o-salicylaldehyde complexing agent (10); photoreductant (see 1-A) (60) |
| transparent poly(ethylene terephthalate) film support |

B. A sample of the photographic element was exposed for 2.5 sec. with a 1000-watt quartz-iodide lamp at a distance of approximately 32 centimeters (1 foot) through a conventional step tablet. Following exposure, the sample was treated for 30 sec. with ammonia fumes while being maintained at a temperature of about 50° C. (120° F.). To imbibe manganese, the sample was immersed for 15 sec. in an aqueous manganese acetate solution containing a $1 \times 10^{-4}$ molar concentration of manganese. The sample was then immersed for 15 sec. in an amplifier bath having the composition set forth in Table VI.

Following amplification, the sample was immersed in a dilute acetic acid bath for the purpose of stopping dye formation, washed in water and dried. The sample contained a positive cyan dye image exhibiting a maximum dye density of greater than 1.9, a minimum density of 0.22 and a contrast of 2.2. A higher maximum density was obtained than by the displacement method of Example 1, although the 5-bromo-o-salicylaldehyde complexing agent generally produces lower maximum dye densties than nitrosoresorcinol when used under comparable conditions. For this reason, the imaging contribution by manganese ions present initially in the gelatin as impurity was considered to account for only a minor portion of the image density.

C. A photographic element was prepared similar to photographic element 1-A, but differing by the substitution of pyridylazoresorcinol, a tridentate ligand complexing agent, for nitrosorecinol, which is a bidentate ligand complexing agent, and further differing in the following proportions: cobalt(III) complex (11), photoreductant (25) and pyridylazoresorcinol (3). A sample of the element was processed as in paragraph 2-B, except that a concentrated gel of ammonium hydroxide was coated onto the radiation-sensitive layer instead of ammonia-fuming.

The exposed and processed sample contained a positive cyan dye image having a maximum density of greater than 1.7, a minimum density of 0.2 and a contrast of 8.0.

EXAMPLE 3

The Silver Imaging Manganese Displacement Approach

A. a photographic element was prepared having a photographic paper support and a silver halide emulsion radiation-sensitive layer coated thereon. The silver halide emulsion layer contained the ingredients set forth below in Table VIII.

Table VIII

| Photographic Element 3-A |
|---|
| silver halide emulsion layer: spectrally sensitized silver chlorobromide having a mean grain size of 0.1 micron (1, based on silver); cyan-dye-forming coupler (see 1-A) (100); coupler solvent (see 1-A) (100); complexing agent nitrosoresorcinol, sodium salt (2); formaldehyde-hardened gelatin (see 1-A) (350) |
| photographic paper support |

Note that manganese ion was supplied as a gelatin impurity.

B. A sample of the photographic element was exposed for 30 sec. with a tungsten light source at a distance of 30.4 cm. Through a conventional step tablet. Following exposure, the sample was placed in a blac-and-white developer of the composition set forth below in Table VIII for 2 min.

Table VIII

| Black-and-White Developer* | |
|---|---|
| sodium sulfite, desiccated | 90.0 g. |
| hydroquinone | 8.0 g. |
| sodium carbonate, monohydrated | 52.5 g. |

Table VIII-continued

| Black-and-White Developer* | |
|---|---|
| potassium bromide | 5.0 g. |
| p-methylaminophenol sulfate | 2.0 g. |
| water to 1 liter | |

*commercially available under the trademark Kodak Developer D-19

The sample was then bleach-fixed for 1 min. in the bleach-fix solution set forth in Table IX.

Table IX

| Bleach-Fix Solution | |
|---|---|
| cobalt hexammine trifluoroacetate | 8 g. |
| potassium thiosulfate | 40 g. |
| water to 1 liter | |

The sample was next placed for 30 sec. in an amplifier solution of the composition set forth in Table X.

Table X

| Amplifier Bath 3-B | |
|---|---|
| color-developing agent: 4-amino-N-ethyl-N-(2-methoxyethyl)-m-toluidine, di-p-toluenesulfonate | 5 g. |
| potassium sulfate | 10 g. |
| potassium sulfite | 2 g. |
| hydrogen peroxide (30% by wt. in water) | 6 g. |
| water to 1 liter (pH 10.5) | |

The sample was placed in a dilute acetic acid solution to stop dye formation, washed with water and dried.

The sample contained a positive cyan dye image having a minimum density of 0.3, a maximum density of 0.7 and a high contrast.

EXAMPLE 4

The Silver Imaging Manganese Imbibition Approach

A. A second sample of the photographic element 3-A was exposed and processed as in paragraph 3-B, except that 0.1 g. of ethylenediamine tetraacetic acid was added to the bleach-fix solution and $1 \times 10^{-5}$ mole of manganese ion in the form of manganese acetate were added to the amplifier bath 3-B. As in Example 3, a positive cyan dye image was obtained, but in this instance the maximum dye density was increased from 0.7 to 2.1. The 1.4 difference in density illustrates the effect of the imbibed manganese and indicates that imbibed manganese could be employed effectively absent any manganese ion impurity initially present in the photographic element.

B. A third sample of the photographic element 3-A was exposed and processed as described above in paragraph 4-A, but with the variation that cobalt hexammine trifluoroacetate was first imbibed for 1 min. into the photographic element before bleaching and fixing using a separate imbibition bath. Bleaching and fixing were carried out in two separate baths for 1 min. each. To form the separate cobalt hexammine trifluoracetate imbibition bath, a black-and-white developer composition as set forth in Table VIII was modified by the addition of 1 g. cobalt hexammine trifluoroacetate and $1 \times 10^{-3}$ mole of ethylenediamine tetraacetic acid. The bleach solution contained 20 g. of potassium ferricyanide per liter of water while the fix solution contained 20 g. of potassium thiosulfate per liter of water. A characteristic curve was produced which generally paralleled that of the second sample, but was displaced upwardly in density (maximum density greater than 2.2). To illustrate the amplification taking place, the negative silver image produced after black-and-white development exhibited a minimum density of 0.04 and a maximum density of 0.12.

Although the invention has been described in considerable detail with particular reference to certain preferred embodiments thereof, variations and modifications can be effected within the spirit and scope of the invention.

What is claimed is:

1. A method of forming a dye image comprising:
imagewise reducing a cobalt(III) complex to cobalt(II) to form an immobile cobalt complex image in an imaging layer of a photographic element,
forming in the imaging layer an immobile catalytic manganese complex image which is a reversal of the cobalt complex image, said manganese complex image exhibiting a substantially higher degree of catalytic activity than said reversal immobile cobalt complex image, and
employing the imaging layer containing the immobile catalytic manganese complex image and the reversal cobalt complex image as a catalyst in a peroxide redox amplification reaction occurring at the site of said manganese complex image to form a dye image.

2. A method according to claim 1 wherein the immobile manganese complex image is employed to form a dye imabe by:
contacting the imaging layer containing the immobile catalytic manganese complex image and the complementary immobile cobalt complex image with a peroxide oxidizing agent and a reducing agent which upon oxidation provides a dye-image-generating reaction product, wherein the peroxide oxidizing agent and the reducing agent are chosen so that they are essentially inert to oxidation-reduction in the absence of a catalyst and
selectively reacting the peroxide oxidizing agent and the reducing agent at the site of the immobile catalytic manganese complex to permit a dye image to be formed which is a reversal of the immobile cobalt complex image.

3. A method according to claim 2 wherein the reducing agent which upon oxidation provides a dye-image-generating reaction product is comprised of a silver halide color-developing agent.

4. A method according to claim 3 wherein the imaging layer contains a color coupler capable of reacting with the oxidized silver halide color-developing agent to form a dye image.

5. A method according to claim 2 wherein the peroxide oxidizing agent is hydrogen peroxide.

6. A method according to claim 2 wherein the immobile catalytic manganese image, the peroxide oxidizing agent and the reducing agent are brought together by immersing the photographic element in a silver-halide color-developer composition containing a silver halide color-developing agent and a peroxide oxidizing agent.

7. A method according to claim 6 wherein the photographic element is immersed in a dilute acidic stop bath following formation of the dye image.

8. A method according to claim 6 wherein the peroxide oxidizing agent is present in the silver halide color-developer composition in a concentration of from 0.001 to 0.5 mole per liter.

9. A method according to claim 6 wherein the silver halide color-developing agent is present in the silver-halide color-developer composition in a concentration of from 1 to 20 grams per liter.

10. A method of forming a dye image comprising:
imagewise reducing a cobalt(III) complex to cobalt(II) to form an immobile cobalt complex image in an element comprised of a support and, as a coating thereon, at least one layer comprised of a substantially uniform distribution of an agent capable of complexing with manganese ions and, preferentially, cobalt(II) ions and radiation-responsive means capable of permitting an imagewise distribution of cobalt(II) ions to be formed,
defining a catalytic image which is a reversal of the immobile cobalt comlex image by providing manganese ions in association with the complexing agent before or after the immobile cobalt complex image is formed and removing manganese ions from the element layer not associated with the complexing agent after the cobalt and manganese complex images are formed to leave in immobile catalytic manganese image and a complementary immobile cobalt complex image, said manganese complex image exhibiting a substantially higher degree of catalytic activity than said complementary immobile cobalt complex image,
contacting the layer containing the immobile catalytic manganese complex image and the complementary immobile cobalt complex image with a peroxide oxidizing agent and a reducing agnet which upon oxidation provides a dye-image-generating reaction product, wherein the peroxide oxidizing agent and the reducing agent are chosen so that they are essentially inert to oxidation-reduction in the absence of a catalyst, and
selectively reacting the peroxide oxidizing agent and the reducing agent at the site of the immobile catalytic manganese complex to permit a dye image to be formed which is a reversal of the image pattern of the immobile cobalt complex.

11. A method according to claim 10 wherein the complexing agent is capable of complexing with manganese to form a bidentate or tridentate ligand.

12. A method according to claim 11 wherein the complexing agent is chosen from the class consisting of ortho-salicylaldehydes, nitroso-arols, dithiooxamides, formazans, aromatic azo compounds, hydrazones and Schiff bases.

13. A method according to claim 10 wherein the complexing agent is a substantially colorless compound.

14. A method according to claim 10 wherein the complexing agent is initially present in a concentration of from $1 \times 10^{-7}$ to $1 \times 10^{-4}$ mole per 0.093 square meter.

15. A method of forming a dye image comprising:
providing an element comprised of a support and, as a coating thereon, at least one layer containing a substantially uniform distribution of a complexing agent, an imagewise distribution of cobalt ions associated with the complexing agent to form an immobile cobalt complex image and a complementary imagewise distribution of manganese ions associated with the complexing agent to form an immobile, catalytic manganese complex reversal image, said manganese complex image exhibiting a substantially higher degree of catalytic activity than said reversal immobile cobalt complex image,
contacting the layer containing the immobile catalytic manganese complex reversal image and the immobile cobalt complex image with a peroxide oxidizing agent and a reducing agent which upon oxidation provides a dye-image-generating reaction product, wherein the peroxide oxidizing agent and the reducing agent are chosen so that they are essentially inert to oxidation-reduction in the absence of a catalyst, and
selectively reacting the peroxide oxidizing agent and the reducing agent at the site of the immobile catalytic manganese complex reversal image to permit a dye image to be formed which is a reversal of the image pattern of the cobalt complex.

16. A method of forming a dye image comprising:
imagewise reducing a cobalt(III) complex to cobalt(II) to form an image pattern of an immobile catalytic manganese complex comprised of manganese ions in coordination with a complexing agent capable of complexing with cobalt(II) ions in preference to manganese ions and a complementary immobile cobalt complex image, said manganese complex image exhibiting a substantially higher degree of catalytic activity than said complementary immobile cobalt complex image, by imagewise displacement of manganese ions from an element comprised of a support and, as a coating thereon, at least one layer comprised of a substantially uniform distribution of the immobile catalytic manganese complex and a radiation-responsive means capable of permitting an imagewise distribution of cobalt(II) ions to be formed,
selectively removing from the element the imagewise-displaced manganese ions,
contacting the layer containing the immobile catalytic manganese complex image and the immobile cobalt complex image with a peroxide oxidizing agent and a reducing agent which upon oxidation provides a dye-image-generating reaction product, wherein the peroxide oxidizing agent and the reducing agent are chosen so that they are essentially inert to oxidation-reduction in the absence of a catalyst, and
selectively reacting the peroxide oxidizing agent and the reducing agent at the site of the immobile catalytic manganese complex image to permit a corresponding dye image to be formed.

17. A method of forming a dye image comprising:
forming an immobile catalytic manganese complex image in an element comprised of a support and, as a coating thereon, at least one layer comprised of a substantially uniform distribution of an immobile catalytic manganese complex and a radiation-sensitive silver halide, comprising:
imagewise-exposing the element layer to actinic radiation,
developing the element to produce a silver image,
bleaching the silver image with a cobalt(III) complex bleaching agent to form cobalt(II) ions as one reaction product, and
displacing manganese from the manganese complex with the cobalt(II) ions form the immobile catalytic manganese complex image and a complementary immobile cobalt complex image, said manganese complex image exhibiting a substantially higher degree of catalytic activity than said complementary immobile cobalt complex image,
selectively removing from the element the manganese displaced from the manganese complex,
contacting the layer containing the immobile catalytic manganese complex image and immobile cobalt complex image with a peroxide oxidizing agent and a reducing agent which upon oxidation provides a dye-image-generating reaction product, wherein the peroxide oxidizing agent and the reducing agent are chosen so that they are essentially inert to oxidiation-reduction in the absence of a catalyst, and selectively reacting the peroxide oxidizing agent and the reducing agent at the site of the immobile catalytic manganese complex image to permit a dye image to be formed.

18. A method according to claim 17 wherein bleaching occurs in a bleach bath having a pH in the range of from 5 to 9.

19. A method according to claim 18 wherein the silver halide is photographically fixed.

20. A method according to claim 19 wherein the radiation-sensitive layer of the element is concurrently bleached and fixed in a bleach-fix bath.

21. A method according to claim 18 wherein the bleach bath contains a cobalt(III) complex bleaching agent.

22. A method according to claim 18 wherein the radiation-sensitive layer contains a cobalt(III) complex bleaching agent before being immersed in the bleach bath.

23. A method according to claim 18 wherein the step of contacting the layer containing the manganese complex image and the complementary immobile cobalt complex image with the peroxide oxidizing agent and the reducing agent and the step of selectively reacting the peroxide oxidizing agent and the reducing agent are accomplished by immersing the element in a redox amplification bath.

24. A method according to claim 23 wherein the displaced manganese is at least partially removed from the element in the redox amplification bath.

25. A method according to claim 18 wherein the manganese complex is comprised of manganese and at least one compound capable of forming an immobilizing bidentate or tridentate ligand therewith.

26. A method of forming a dye image comprising:

providing an element comprised of a support and, as a coating thereon, at least one layer comprised of a substantially uniform distribution of a radiation-sensitive silver halide and an immobile catalytic manganese complex comprised of manganese and at least one compound forming an immobilizing bidentate or tridentate complex therewith, the manganese being present in a concentration of from $1 \times 10^{-7}$ to $1 \times 10^{-4}$ mole per 0.093 square meter, imagewise-exposing the element layer to actinic radiation, immersing the exposed element in a silver halide developer solution to achieve development of silver in an imagewise manner, immersing the element in a photographic bleaching solution having a pH in the range of from 5 to 9, at least one of the element and the bleach solution containing a cobalt(III) complex bleaching agent, thereby in an imagewise manner forming cobalt(II) ions as a reaction product which in turn displace manganese from the immobile catalytic manganese complex so that an immobile catalytic manganese image is defined and a complementary immobile cobalt complex image is formed, said manganese complex image exhibiting a substantially higher degree of catalytic activity than said complementary immobile cobalt complex image, and immersing the element in a redox amplification solution containing a peroxide oxidizing agent and a silver halide color-developing agent, at least one of the element and the amplification solution containing a color coupler and the peroxide oxidizing agent and the silver halide color-developing agent being chosen to be substantially inert to oxidation-reduction in the absence of a catalyst, so that the peroxide oxidizing agent selectively oxidizes the silver halide color-developing agent at the site of the immobile catalytic manganese image to form a dye image.

27. A method according to claim 26 wherein the bleaching solution has a pH in the range of from 6 to 8.

28. A method according to claim 26 wherein the manganese complexing compound is chosen from the group consisting of ortho-salicylaldehydes, nitroso-arols, dithiooxamides, formazans, aromatic azo compounds, hydrazones and Schiff bases.

29. A method according to claim 26 wherein the manganese complexing compound is an ortho-salicylaldehyde.

30. A method according to claim 26 wherein the manganese complexing compound is a nitroso-arol of the formula:

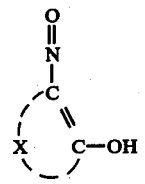

wherein X is comprised of the atoms necessary to complete a phenyl or naphthyl ring.

31. A method according to claim 26 wherein the manganese complexing compound is an aromatic azo compound defined by the formula:

$$Z^2—N=N—Z^3$$

wherein $Z^2$ and $Z^3$ are independently chosen from among aromatic groups capable of forming chelate ligands.

32. A method according to claim 26 wherein the color coupler is incorporated in the element.

33. A method according to claim 26 wherein the cobalt(III) complex is initially contained within the bleaching solution.

34. A method according to claim 26 wherein the cobalt(III) complex is present in the element before it is immersed in the bleaching solution.

35. A method of forming a dye image comprising:

providing an element comprised of a support and, as a coating thereon, at least one layer comprised of a substantially uniform distribution of a radiation-sensitive silver halide, an incorporated color coupler, and an immobile catalytic complex of manganese and a complexing agent chosen from the group consisting of nitroresorcinol, 5-bromo-o-salicylaldehyde and pyridylazoresorcinol, imagewise-exposing the element layer to actinic radiation, immersing the exposed element in a silver halide developer solution to achieve development of silver in an imagewise manner, immersing the element in a photographic bleaching solution having a pH in the range of from 5 to 9, at least one of the element and the bleaching solution containing cobalt hexammine, thereby in an imagewise manner forming cobalt(II) ions as a reaction product which in turn displace manganese from the immobile catalytic manganese complex so that an immobile catalytic manganese image is defined and a complementary immobile cobalt complex image is formed, said manganese complex image exhibiting a substantially higher degree of catalytic activity than said complementary immobile cobalt complex image, and immersing the element in a redox amplification solution containing a peroxide oxidizing agent and a silver halide color-developing agent, so that the hydrogen peroxide selectively oxidizes the silver halide color-developing agent at the site of the immobile catalytic manganese image to form a corresponding dye image.

36. A method of forming a dye image comprising:

forming an immobile catalytic manganese complex image in an element comprised of a support and, as a coating thereon, at least one layer comprised of a substantially uniform distribution of an immobile catalytic manganese complex and a cobalt(III) complex, comprising:

imagewise-reducing the cobalt(III) complex in the element layer to form cobalt(II) ions as a reaction product and displacing manganese from the manganese complex with the cobalt(II) ions, so that the immobile catalytic manganese image and a complementary immobile cobalt complex image are formed, said manganese complex image exhibiting a substantially higher degree of catalytic activity than said complementary cobalt complex image, selectively removing from the element the manganese displaced from the manganese complex, contacting the layer containing the immobile catalytic manganese complex image and the immobile cobalt complex image with a peroxide oxidizing agent and a reducing agent which upon oxidation provides a dye-image-generating product, wherein the peroxide oxidizing agent and the reducing agent are chosen so that they are essentially inert to oxidation-reduction in the absence of a catalyst, and selectively reacting the peroxide oxidizing agent and the reducing agent at the site of the immobile catalytic manganese complex image to permit a dye image to be formed.

37. A method according to claim 36 wherein the cobalt(III) complex is a cationic cobalt amine or ammine ligand-containing complex with the cobalt having a coordination number of 6.

38. A method according to claim 37 wherein the cobalt(III) complex is a cationic cobalt hexammine complex.

39. A method according to claim 36 wherein the element contains a photoactivator.

40. A method according to claim 39 wherein the photoactivator is a photoreductant or a spectral sensitizer for the cobalt(III) complex.

41. A method according to claim 40 wherein the photoreductant is chosen from the class consisting of quinone, disulfide, diazoanthrone, diazonium salt, diazophenanthrone, aromatic azide, acyloin, aromatic ketone, aromatic carbazide, diazosulfonate, aziridine and 2H-benzimidazole photoreductants.

42. A method according to claim 41 wherein the photoreductant is an internal hydrogen source quinone.

43. A method according to claim 36 wherein the manganese complex contains manganese and at least one compound forming an immobilizing bidentate or tridentate chelate with the manganese.

44. A method comprising:

imagewise reducing a cobalt(III) complex to cobalt(II) to form an immobile catalytic manganese complex image and a complementary immobile cobalt complex image, said manganese complex image exhibiting a substantially higher degree of catalytic activity than said complementary immobile cobalt complex image, in an element comprised of a support and, as a coating thereon, at least one layer comprised of a substantially uniform distribution of (a) an immobile catalytic manganese complex comprised of manganese and at least one bidentate or tridentate chelate ligand-forming complexing agent chosen from the group consisting of ortho-salicylaldehydes, nitrosoarols, dithiooxamides, formazans, aromatic azo compounds, hydrazones and Schiff bases, (b) a cationic cobalt(III) ammine or amine complex and (c) a photoreductant, by imagewise-exposing to visible radiation and heating the coating, and forming a dye image defined by said immobile catalytic manganese complex image by immersing the element in a redox amplification bath comprising a peroxide oxidizing agent and a color-developing agent, wherein the peroxide oxidizing agent and the color-developing agent are chosen so that they are essentially inert to oxidation-reduction in the absence of a catalyst, but enter into a redox amplification reaction at the site of said manganese complex image, at least one of the element and the amplification bath containing a color coupler.

45. A method according to claim 44 wherein the manganese complexing agent is an ortho-salicylaldehyde.

46. A method according to claim 44 wherein the manganese complexing agent is a nitroso-arol of the formula:

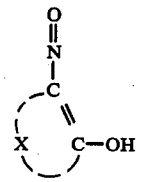

wherein X is comprised of the atoms necessary to complete a phenyl or naphthyl ring.

47. A method according to claim 44 wherein the manganese complexing agent is an aromatic azo compound defined by the formula:

$$Z^2—N=N—Z^3$$

wherein $Z^2$ and $Z^3$ are independently chosen from among aromatic groups capable of forming chelate ligands.

48. A method according to claim 44 wherein the color coupler is incorporated in the element.

49. A method according to claim 44 wherein mobile manganese ions are washed from the element prior to immersing the element in the amplification bath.

50. A method comprising:

imagewise reducing a cobalt(III) complex to cobalt(II) to form an immobile catalytic manganese complex image and a complementary immobile cobalt complex image, said manganese complex image exhibiting a substantially higher degree of catalytic activity than said complementary immobile cobalt complex image, in an element comprised of a support and, as a coating thereon, at least one layer comprised of a substantially uniform distribution of (a) an immobile catalytic complex manganese and a complexing agent chosen from the group consisting of nitrosoresorcinol, 5-bromo-o-salicylaldehyde and pyridylazoresorcinol, (b) a cobalt hexammine, (c) an incorporated color coupler and (d) an internal hydrogen source quinone photoreductant, by imagewise-exposing to visible radiation and heating the coating, and forming a dye image defined by said immobile catalytic manganese image by immersing the element in a redox amplification solution containing hydrogen peroxide and a colordeveloping agent so that a redox amplification reaction occurs at the site of the immobile catalytic manganese image.

51. A method of forming a dye image comprising:

imagewise reducing a cobalt(III) complex to cobalt(II) to form an immobile cobalt complex image in an element comprised of a support and, as a coating thereon, at least one layer comprised of a substantially uniform distribution of an agent capable of complexing and immobilizing manganese or cobalt ions and a radiation-responsive means capable of permitting an imagewise distribution of cobalt ions to be formed, forming an imagewise distribution of an immobile catalytic manganese complex by introducing manganese ions into the element to form a catalytic manganese complex with residual complexing agnet not complexed with cobalt, so that an immobile catalytic manganese complex image and a complementary immobile cobalt complex image are formed, the manganese complex image exhibiting a substantially higher degree of catalytic activity than said complementary immobile cobalt complex image, contacting the layer containing the immobile catalytic manganese complex image and the complementary immobile cobalt complex image with a peroxide oxidizing agent and a reducing agent which upon oxidation provides a dye-image-generating reaction product, wherein the peroxide oxidizing agent and the reducing agent are chosen so that they are essentially inert to oxidation-reduction in the absence of a catalyst, and selectively reacting the peroxide oxidizing agent and the reducing agent at the site of the immobile catalytic manganese complex image to permit a dye image to be formed which is a reversal of the cobalt complex image generated.

52. A method of forming a dye image comprising:

forming an immobile cobalt complex image in an element comprised of a support and, as a coating thereon, at least one layer comprised of a substantially uniform distribution of an agent capable of complexing and immobilizing manganese and cobalt ions and a radiation-sensitive silver halide, comprising:

imagewise-exposing the element layer to actinic radiation, developing the exposed element to produce a silver image, bleaching the silver image with a cobalt(III) complex-containing bleaching agent to form cobalt(II) ions as one reaction product, and reacting the cobalt(II) ions and the complexing agent to form an immobile cobalt complex image, forming an imagewise distribution of an immobile catalytic manganese complex by introducing manganese ions into the element to form a catalytic manganese complex with residual complexing agent not complexed with cobalt, so that an immobile catalytic manganese complex image and a complementary immobile cobalt complex image are formed, the manganese complex image exhibiting a substantially higher degree of catalytic activity than said complementary immobile cobalt complex image, contacting the layer containing the immobile catalytic manganese complex image and the complementary immobile cobalt complex image with a peroxide oxidizing agent and a reducing agent which upon oxidation provides a dye-image-generating reaction product, wherein the peroxide oxidizing agent and the reducing agent are chosen so that they are essentially inert to oxidation-reduction in the absence of a catalyst, and selectively reacting the peroxide oxidizing agent and the reducing agent at the site of the immobile catalytic manganese complex image to permit a dye image to be formed which is a reversal of the cobalt complex image generated.

53. A method according to claim 52 wherein bleaching occurs in a bleach bath having a pH in the range of from 5 to 9.

54. A method according to claim 53 wherein the silver halide is photographically fixed.

55. A method according to claim 54 wherein the radiation-sensitive layer of the element is concurrently bleached and fixed in a bleach-fix bath.

56. A method according to claim 53 wherein the bleach bath contains a cobalt(III) complex bleaching agent.

57. A method according to claim 53 wherein the radiation-sensitive layer contains a cobalt(III) complex bleaching agent before being immersed in the bleach bath.

58. A method according to claim 53 wherein the step of contacting the manganese complex image with the peroxide oxidizing agent and the reducing agent and the step of selectively reacting the peroxide oxidizing agent and the reducing agent are accomplished by immersing the element in a redox amplification bath.

59. A method according to claim 58 wherein mobile manganese ions are at least partially removed from the element prior to immersing the element in the redox amplification bath.

60. A method according to claim 53 wherein the manganese ions are introduced into the element by immersing the element in a solution containing manganese ions in a concentration of from $1 \times 10^{-5}$ to $1 \times 10^{-2}$ mole per liter.

61. A method comprising:

providing an element comprised of a support and, as a coating thereon, at least one layer comprised of a substantially uniform distribution of a radiation-sensitive silver halide and at least one compound capable of forming an immobilizing bidentate or tridentate complex with either manganese or cobalt, the complex-forming compound being present in a concentration of from $1 \times 10^{-7}$ to $1 \times 10^{-4}$ mole per 0.093 square meter.

imagewise-exposing the element layer to actinic radiation, immersing the exposed element in a silver halide developer solution to achieve development of silver in an imagewise manner, immersing the element in a photographic bleaching solution having a pH in the range of from 5 to 9, at least one of the element and the bleach solution containing a cobalt(III) complex bleaching agent, thereby in an imagewise manner forming cobalt(II) ions which in turn react with the complex-forming compound to form an immobile cobalt complex image, immersing the element in a solution containing from $1 \times 10^{-5}$ to $1 \times 10^{-2}$ mole per liter of mobile manganese ions to form a catalytic manganese complex with residual complexforming compound not complexed with cobalt, so that an immobile catalytic manganese complex image and a complementary immobile cobalt complex image are formed, the manganese complex image exhibiting a substantially higher degree of catalytic activity than said complementary immobile cobalt complex image, immersing the element in a redox amplification bath containing a peroxide oxidizing agent and a silver halide color-developing agent, at least one of the element and the amplification bath containing a color coupler and the peroxide oxidizing agent and the silver halide color-developing agent being chosen to be substantially inert to oxidation-reduction in the absence of a catalyst, so that the peroxide oxidizing agent oxidizes the silver halide color-developing agent at the site of the immobile catalytic manganese complex image to form a dye image.

62. A method according to claim 61 wherein the bleaching solution has a pH in the range of from 6 to 8.

63. A method according to claim 61 wherein the complex-forming compound is chosen from the group consisting of ortho-salicylaldehydes, nitroso-arols, dithiooxamides, formazans, aromatic azo compounds, hydrazones and Schiff bases.

64. A method according to claim 61 wherein the manganese complexing compound is an ortho-salicylaldehyde.

65. A method according to claim 61 wherein the manganese complexing compound is a nitroso-arol of the formula:

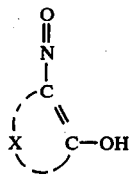

wherein X is comprised of the atoms necessary to complete a phenyl or naphthyl ring.

66. A method according to claim 61 wherein the manganese complexing compound is an aromatic azo compound defined by the formula:

$$Z^2—N=N—Z^3$$

wherein $Z^2$ and $Z^3$ are independently chosen from among aromatic groups capable of forming chelate ligands.

67. A method according to claim 61 wherein the color coupler is incorporated in the element and the silver halide color-developing agent is initially present in the redox amplification bath.

68. A method according to claim 61 wherein the cobalt(III) complex is initially contained within the bleaching solution.

69. A method according to claim 61 wherein the cobalt(III) complex is present in the element before it is immersed in the bleaching solution.

70. A method according to claim 61 wherein mobile manganese ions are washed from the element before it is immersed in the amplification bath.

71. A method comprising:

providing an element comprised of a support and, as a coating thereon, at least one layer comprised of a substantially uniform distribution of a radiation-sensitive silver halide and from $1 \times 10^{-7}$ to $1 \times 10^{31\,4}$ mole per 0.093 square meter of a complexing agent chosen from the group consisting of nitrosoresorcinol, 5-bromo-o-salicylaldehyde and pyridlyazoresorcinol, and a color coupler, imagewise-exposing the element layer to actinic radiation, immersing the exposed element in a black-and-white silver halide developer to achieve development of silver in an imagewise manner, immersing the element in a photographic bleaching solution having a pH in the range of from 6 to 8, at least one of the element and the bleaching solution containing cobalt hexammine, thereby in an imagewise manner forming cobalt(II) ions which in turn react with the complex-forming compound to form an immobile cobalt complex image, immersing the element in a solution containing from $1 \times 10^{-5}$ to $1 \times 10^{-2}$ mole per liter of mobile manganese ions so that an immobile catalytic manganese complex image and a complementary immobile cobalt complex image are formed, the manganese complex image exhibiting a substantially higher degree of catalytic activity than said complementary immobile cobalt complex image, immersing the element in a redox amplification bath containing hydrogen peroxide and a phenylenediamine silver halide color-developing agent, so that the hydrogen peroxide selectively oxidizes the silver halide color-developing agent at the site of the immobile catalytic manganese image to form a corresponding dye image.

72. A method of forming a dye image comprising:

forming an immobile cobalt image in an element comprised of a support and, as a coating thereon, at least one layer comprised of a cobalt(III) complex and a substantially uniform distribution of an agent capable of complexing manganese of cobalt ions, comprising:

imagewise-reducing the cobalt(III) complex in the element layer to form cobalt(II) ions as a reaction product and reacting the cobalt(II) ions and the complexing agent to form an immobile cobalt(II) complex image, forming an imagewise distribution of an immobile catalytic manganese complex by introducing manganese ions into the element to form a catalytic manganese complex with residual complexing agent not complexed with cobalt, so that an immobile catalytic manganese complex image and a complementary immobile cobalt complex image are formed, the manganese complex image exhibiting a substantially higher degree of catalytic activity than said complementary immobile cobalt complex image, contacting the layer containing the immobile catalytic manganese complex image and the complementary immobile cobalt complex image with a peroxide oxidizing agent and a reducing agent which upon oxidation provides a dye-image-generating reaction product, wherein the peroxide oxidizing agent and the reducing agent are chosen so that they are essentially inert to oxidation-reduction in the absence of a catalyst, and selectively reacting the peroxide oxidizing agent and the reducing agent at the site of the immobile catalytic manganese complex image to permit a dye image to be formed which is a reversal of the cobalt complex image generated.

73. A method according to claim 72 wherein the cobalt(III) complex is a cationic cobalt amine or ammine ligand-containing complex with the cobalt having a coordination number of 6.

74. A method according to claim 73 wherein the cobalt(III) complex is a cationic cobalt hexammine complex.

75. A method according to claim 72 wherein the element contains a photoactivator when imagewise-exposed.

76. A method according to claim 75 wherein the photoactivator is a photoreductant or a spectral sensitizer for the cobalt(III) complex.

77. A method according to claim 76 wherein the photoreductant is chosen from the class consisting of quinone, disulfide, diazoanthrone, diazonium salt, diazophenanthrone, aromatic azide, acyloin, aromatic ketone, aromatic carbazide, diazosulfonate, aziridine and 2H-benzimidazole photoreductants.

78. A method according to claim 77 wherein the photoreductant is an internal hydrogen source quinone.

79. A method according to claim 72 wherein the complex-forming compound forms an immobilizing bidentate or tridentate chelate with the manganese.

80. A method comprising providing an element comprised of a support and, as a coating thereon, at least one layer comprised of a substantially uniform distribution of (a) at least one compound capable of forming an immobile complex with manganese and cobalt chosen from the group consisting of ortho-salicylaldehydes, nitroso-arols, dithiooxamides, formazans, aromatic azo compounds, hydrazones and Schiff bases, (b) a cationic cobalt(III) ammine or amine complex and (c) a photoactivator, the complex-forming compound being present in a concentration of from $1 \times 10^{-7}$ to $1 \times 10^{-4}$ mole per 0.093 square meter, imagewise-exposing to actinic radiation and heating the coating, thereby in an imagewise manner forming cobalt(II) ions which in turn react with the complex-forming compound to form an immobile cobalt complex image, immersing the element in a solution containing from $1 \times 10^{-5}$ to $1 \times 10^{-2}$ mole per liter of mobile manganese ions so that an immobile catalytic manganese complex image and a complementary immobile cobalt complex image are formed, the manganese complex image exhibiting a substantially higher degree of catalytic activity than said complementary immobile cobalt complex image, immersing the element in a redox amplification bath containing a peroxide oxidizing agent, at least one of the element and the amplification bath containing a color coupler and a silver halide color-developing agent and the peroxide oxidizing agent and the silver halide color-developing agent being chosen to be substantially inert to oxidation-reduction in the absence of a catalyst, so that the peroxide oxidizing agent selectively oxidizes the silver halide color-developing agent at the site of the immobile catalytic manganese complex image to form a dye image.

81. A method according to claim 80 wherein the manganese complexing agent is an ortho-salicylaldehyde.

82. A method according to claim 80 wherein the manganese complexing agent is a nitroso-arol of the formula:

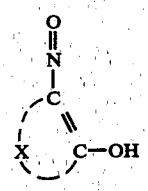

wherein X is comprised of the atoms necessary to complete a phenyl or naphthyl ring.

83. A method according to claim 80 wherein the manganese complexing agent is an aromatic azo compound defined by the formula:

$$Z^2-N=N-Z^3$$

wherein $Z^2$ and $Z^3$ are independently chosen from among aromatic groups capable of forming chelate ligands.

84. A method according to claim 80 wherein the color coupler is incorporated in the element.

85. A method comprising:

providing an element comprised of a support and, as a coating thereon, at least one layer comprised of a substantially uniform distribution of (a) from $1 \times 10^{-7}$ to $1 \times 10^{-4}$ mole per 0.093 square meter of a complexing agent chosen from the class consisting of nitrosoresorcinol, 5-bromo-o-salicylaldehyde and pyridylazoresorcinol, (b) a cobalt hexammine, (c) an incorporated color coupler and (d) an internal hydrogen source quinone photoreductant, imagewise-exposing to actinic radiation and heating the coating, thereby in an imagewise manner forming cobalt(II) ions which in turn react with the complex-forming compound to form an immobile cobalt complex image, immersing the element in a solution containing from $1 \times 10^{-5}$ to $1 \times 10^{-2}$ mole per liter of mobile manganese ions so that an immobile catalytic manganese complex image and a complementary immobile cobalt complex image are formed, the manganese complex image exhibiting a substantially higher degree of catalytic activity than said complementary immobile cobalt complex image, immersing the element in a redox amplification bath containing hydrogen peroxide and a silver halide color-developing agent, so that the hydrogen peroxide selectively oxidizes the silver halide color-developing agent at the site of the immobile catalytic manganese image to form a corresponding dye image.

* * * * *